US009290937B2

(12) United States Patent
Pendley et al.

(10) Patent No.: US 9,290,937 B2
(45) Date of Patent: Mar. 22, 2016

(54) METHOD OF APPLYING SUSPENSION FABRIC IN A FALL PROTECTION SYSTEM

(71) Applicants: Timothy Pendley, Madera, CA (US); Michael J. McLain, Green Bay, WI (US)

(72) Inventors: Timothy Pendley, Madera, CA (US); Michael J. McLain, Green Bay, WI (US)

(73) Assignee: Mate, LLC, Green Bay, WI (US)

( * ) Notice: Subject to any disclaimer, the term of this patent is extended or adjusted under 35 U.S.C. 154(b) by 0 days.

(21) Appl. No.: 14/203,943

(22) Filed: Mar. 11, 2014

(65) Prior Publication Data

US 2015/0259908 A1 Sep. 17, 2015

(51) Int. Cl.

| | |
|---|---|
| ***E04B 7/18*** | (2006.01) |
| ***E04B 7/00*** | (2006.01) |
| *E04D 13/16* | (2006.01) |

(52) U.S. Cl.

CPC ..... *E04B 7/18* (2013.01); *E04D 13/1612* (2013.01); *E04B 7/00* (2013.01); *E04D 13/1625* (2013.01)

(58) Field of Classification Search

CPC ... E04D 13/1612; E04D 13/1625; E04D 5/00; E04D 12/00; E04D 15/00; E04D 15/06; E04B 7/00; E04B 1/62; E04B 7/18

USPC ..... 52/96, 506.05, 676, 745.06, 746.11, 52/279, 407.4

See application file for complete search history.

(56) References Cited

U.S. PATENT DOCUMENTS

| | | | | |
|---|---|---|---|---|
| 2,068,133 | A * | 1/1937 | Hindall | 156/462 |
| 3,969,863 | A | 7/1976 | Alderman | |
| 4,047,346 | A | 9/1977 | Alderman | |
| 4,446,664 | A | 5/1984 | Harkins | |
| 4,573,298 | A | 3/1986 | Harkins | |
| 4,875,320 | A | 10/1989 | Sparkes | |
| 5,201,152 | A | 4/1993 | Heffner | |
| 5,251,412 | A * | 10/1993 | de Almeida Borges | 52/109 |
| 5,251,415 | A * | 10/1993 | Van Auken et al. | 52/407.4 |
| 5,406,764 | A | 4/1995 | Van Auken et al. | |

(Continued)

FOREIGN PATENT DOCUMENTS

WO 2012145783 11/2012

OTHER PUBLICATIONS

Guardian Energy Saver FP, printed from Internet Aug. 4, 2014, 23 pages.

Guardian Energy Saver FP, Roof System Installation Instructions, 2009, 4 pages Guardian Building Products Distribution, Inc., Solon, Ohio.

(Continued)

*Primary Examiner* — Phi A

(74) *Attorney, Agent, or Firm* — Thomas D. Wilhelm; Whilhelm Law, S.C.

(57) ABSTRACT

This invention provides suspension fabric product, methods of making such product, and methods of installing such product, in fall protection systems used in metal building construction. The fabric product is presented Z-folded on a core, with essentially all surface air removed, and wrapped in a protective plastic wrapping which extends into the roll alongside outer layers of the roll of fabric. Essentially all surface air is removed from the Z-folded fabric at a compression station as the roll is being fabricated. Use of the roll includes extending a shaft through the core, elevating the roll to a working height at the roof elevation, temporarily mounting the shaft to existing roof structural members of the building being constructed, and drawing a leading edge of the fabric from the roll and along a run of the space between next adjacent ones of the purlins and across the space between first and second ones of the rafters.

42 Claims, 14 Drawing Sheets

(56) References Cited

U.S. PATENT DOCUMENTS

| | | | | |
|---|---|---|---|---|
| 5,495,698 | A * | 3/1996 | Alderman et al. | 52/742.12 |
| 5,664,740 | A * | 9/1997 | Alderman et al. | 242/592 |
| 5,901,518 | A * | 5/1999 | Harkins | 52/404.3 |
| 5,953,875 | A * | 9/1999 | Harkins | 52/407.3 |
| 6,003,282 | A * | 12/1999 | Alderman et al. | 52/749.12 |
| 6,226,945 | B1 | 5/2001 | Henry et al. | |
| 6,247,277 | B1 | 6/2001 | Kerpash, Sr. | |
| 6,401,426 | B1 | 6/2002 | Alderman et al. | |
| 6,421,980 | B1 * | 7/2002 | Alderman et al. | 52/746.11 |
| 6,748,715 | B1 | 6/2004 | Black et al. | |
| 8,590,245 | B2 * | 11/2013 | Peng et al. | 52/407.4 |
| 8,991,110 | B1 * | 3/2015 | Harkins | 52/169.11 |
| 2002/0020584 | A1 | 2/2002 | Cjepa | |
| 2003/0114055 | A1 | 6/2003 | Burton et al. | |
| 2011/0067345 | A1 | 3/2011 | Crostic, Jr. et al. | |
| 2012/0174502 | A1 | 7/2012 | Oberg | |
| 2013/0108377 | A1 | 5/2013 | Steffenino | |
| 2013/0305623 | A1 | 11/2013 | Pendley et al. | |

OTHER PUBLICATIONS

Silvercote Lamination, ES Energy Saver FP, brochure, Copyright 2014, 20 pages, Silvercote Laminations, Greer, South Carolina.

Guardian Building Products Distribution, Inc., Guardian ES Energy Saver FP, Product Specification Sheet, Copyright 2011, 2 pages, Guardian Building Products, Greer, South Carolina.

Harris Steel, Industry properties for Steel Sheets—Cold Rolled & Hot Dipped Zinc Coated, Specification Sheet, Found by Patent Examiner Feb. 2015, 2 pages, Harris Steel.

Steelscape, A Bluescope Steel Company, Zincalume Steel Grade 50 (Class 1), Grade Data Sheet, Jul. 1, 2012, 1 page, Steelscape.

Steelscape, A Bluescope Steel Company, Zincalume Steel Grade 80 (Class 1), Grade Data Sheet, Jul. 1, 2012, 1 page, Steelscape.

Maple Leaf Sales, K-Grip 514 Flammable Foam, Product Data Sheet, received Feb. 3, 2014, 1 page.

Maple Leaf Sales II, Inc., 514 Macroplast Adhesive, Material Safety Data Sheet, dated Jul. 16, 2010, 3 pages.

* cited by examiner

METHOD OF APPLYING SUSPENSION FABRIC IN A FALL PROTECTION SYSTEM

BACKGROUND OF THE INVENTION

This invention relates to buildings, building components, building subassemblies, and building assemblies, and to methods of constructing buildings. This invention relates specifically to components, subassemblies, and assemblies, as parts of the building, and to the issue of worker safety during the construction of buildings.

From time to time, injuries occur during construction of buildings, including to workers who fall from elevated heights. The focus of this invention is to provide novel methods of installing fall protection systems in buildings being constructed, thereby to assist building contractors in reducing, desirably eliminating, the number of incidents of worker injuries resulting from workers falling from elevated heights while working on construction of such building.

Governmental safety organizations, for example the Occupational Safety and Health Administration (OSHA) in the US, have promulgated required safety standards, and safety practices to generally provide safety systems which capture and support workers who are working at substantial heights above supporting surfaces, to protect such workers, namely to stop a fall, and to support such workers if/when such workers do fall. But it is up to the industry to create fall protection systems which meet the required standards.

Pre-engineered metal building systems are the predominant method of non-residential low rise construction for buildings. Existing fall protection standards have substantial impact on the contractors involved in such pre-engineered metal building systems.

One way a worker can be protected, according to the standards, is for the worker to wear a safety harness which is tied, by a strap, to the building structure at elevation such that the harness/strap combination stops any fall which the worker experiences before the worker encounters an underlying surface such as a floor or the ground. Use of such safety harness is known as "tying off". But tying the harness to the building limits the worker's mobility, as well as the worker's range of movement. Thus, tie-off harnesses are not viewed favorably in the industry because of worker inefficiency.

Another way workers can be protected is for the building contractor to erect safety nets in order to provide protection against falls. Cost and maintenance of such safety nets, as well as the equipment and expense required for erecting and dismantling the net and associated equipment, and moving and storing the net and equipment, can be a substantial increment in the per square foot cost of especially the roof insulation system being installed.

With the anticipation of expanded enforcement efforts by government safety officials, building erectors have increasing incentive to find ways to meet the existing fall protection requirements.

Another acceptable type of fall protection system is a passive system wherein a fabric, such as a solid sheet, a woven sheet, or a net-like material, is suspended at or below the work area, optionally supported by a grid of crossing support bands, far enough above any underlying supporting surface to catch and support a worker who falls, thereby to act as a passive fall-protection system.

OSHA has defined a drop test procedure whereby a such passive fall protection system can be tested. According to the test procedure, a 400 pound weight is dropped onto the fall protection system under stated conditions to determine whether a given system meets the required safety standards.

For purposes of complying with government regulations, any system used as a fall protection system need only meet the OSHA-mandated standards related to dropping such 400 pound weight. Of course, the real humanitarian objective is to prevent worker injuries if/when a worker falls from an elevated work location. Thus, any fall protection system which is effective to catch and safely hold a falling worker has operational value, even if such system does not meet OSHA standards.

According to one aspect of the prior art, currently in use in the metal building industry, and intended to meet OSHA fall protection standards, a purported fall protection system uses crossing longitudinal and lateral metal bands extending under the eave, under the ridge, and under the intermediate purlins. A suspension fabric is installed above the bands and under the purlins, the eaves, and the ridges, extending across the entirety of the width of a respective bay of the building being constructed, thereby providing a suspended fabric intended to catch and support a falling worker in that bay. Insulation is ultimately installed on top of the fabric whereby the fabric ultimately functions as the vapor barrier portion of the building ceiling insulation system in the finished building.

Suspension fabric is fabricated to specific dimensions for each given building being constructed. Thus, sheets of fabric may be seamed together longitudinally in order to make a finished fabric which can extend the full length, e.g. eave to ridge, and the full width, of a particular bay of a particular building being constructed.

Once the length and width of the fabric have been established and so fabricated, the fabric is Z-folded such that the creases in the "Z" extend along the width of the fabric, and such that the width of the so-Z-folded fabric is less than the specified width along the run, from rafter to rafter, between adjacent ones of the purlins in the building being constructed. In conventionally-known fabrication of the fabric, starting at one end of the Z-folded construction, a length of the thus-Z-folded fabric is then repeatedly folded onto itself in e.g. 3-foot long segments until the entirety of the Z-folded length has been incorporated into the folded-onto-itself construct.

The resulting bundle of fabric somewhat resembles a folded tarp. Such folded bundle of product may be about 3 feet long along the width of the sheeting and up to 3-4 feet long in a cross direction along that length of the sheet which will ultimately be installed between the eave and the ridge of the building.

The so-folded product bundle can be wrapped in e.g. plastic film. The resulting product bundle typically contains quite a bit of air such that the bundle is soft, thus somewhat dimensionally unstable. The bundle can also be weighty, typically weighing about 50 pounds to about 80 pounds.

Once at the construction site, the so-folded conventionally-fabricated suspension fabric is raised to an elevation above its installation height, and placed onto a grid-work of widely-spaced longitudinal and lateral support bands in a bay into which the fabric is to be installed, with the width of the fabric extending dimensionally along the width of the building bay, and the length of the fabric extending between the ridge and the eave of the building. The plastic packaging film is then removed and the bundle is unfolded across the width of the respective bay. With the fabric bundle thus unfolded, the fabric is still in, its Z-folded configuration, extending across essentially the full width of the bay.

Once the fabric has been extended across generally the full width of the bay, still in the Z-folded configuration, the side edges of the fabric, namely those edges which extend along the lengths of the respective first and second rafters, are in position proximate the respective ones of the rafters. Opposing ends of the fabric, which are designed to extend along the eave and the ridge, are then worked under the purlins, under the eaves and under the ridges, thus to extend the fabric the full extent of its length and width in the bay.

Such "positioning" of the fabric presents certain challenges. First, the dimensionally unstable fabric bundle is difficult to handle because of its dimensional instability. The bundle is initially placed at elevation on a collection of discontinuous surfaces, namely on top of the first rafter and/or on a longitudinal band. The fabric bundle may also overlie a lateral band and thus be supported by both a longitudinal band and a lateral band. As can be seen in FIGS. 2 and 4, the banding and the rafter present relatively small support surface areas for supporting the fabric bundle, and substantial-size openings, spacings, are disposed between such respective support members.

Thus, balancing the dimensionally-unstable fabric bundle on such small support surfaces presents a first challenge.

A second challenge is found in the unfolding of the fabric bundle across the width of the bay to the second rafter. Namely, and referring to FIGS. 2 and 4, in order for a worker to get enough leverage to be able to manipulate the fabric bundle across the band grid-work, the worker, working from an e.g. scissors and/or other hydraulic lift, will typically be high enough to stick his head up above the band grid-work in order to be able to handle the heavy fabric bundle, namely to effectively control the fabric bundle while unfolding the fabric bundle across the width of the bay. So the process of getting the fabric onto supports in the bay, and the process of extending the fabric across the bay, are strenuous, labor-intensive tasks.

The instructions known to the applicants herein, for positioning the fabric, simply say "unwrap and position . . . the fabric between . . . two purlins". But there is no teaching in the art regarding how one efficiently, and safely, unwraps the fabric, and positions the fabric onto the band grid-work across that open space. The process of unwrapping the fabric may be straight-forward, because the fabric need not be moved in order to unwrap the fabric. However, the "positioning" of the fabric requires movement of the fabric, as well as change in the form of the fabric product, from a folded, bundle form to that of a flat, multiple-layer, Z-folded temporary form. And while the grid-work of banding can support the unfolded, laid-out-flat. Z-folded fabric, across the bay between the first and second rafters, the banding does not, will not, safely support a worker. And in the process of "positioning" the fabric, laid out flat between the purlins, the Z-folded fabric must be manipulated across the width of the bay.

Accordingly, there is a need for an easier, more efficient method of positioning the fabric at the working, install elevation.

Further, there is a need for a more efficient method of extending the fabric across the width of the bay in the process of installing the fabric over the bay.

Further, there is a need to provide a novel fabric product which is more easily extended/distributed across the width of the bay.

Yet further, there is a need to provide a novel method of converting the suspension fabric material into a fabric product which is easier to position and install.

These and other needs are alleviated, or at least attenuated, or partially or completely satisfied, by novel products, systems, and/or methods of the invention.

SUMMARY OF THE INVENTION

This invention relates to fabrics used in fall protection systems which are employed when constructing low-rise non-residential buildings, to protect workers working at dangerous, elevated, heights. Specifically, the invention provides a novel suspension fabric product configuration, in the form of a Z-folded, then rolled, fabric having substantially all the surface air removed, the fabric being mounted on a semi-rigid e.g. cardboard-type, core. The invention also provides novel methods of fabricating such Z-folded fabric product in roll form, including removing essentially all of the surface air from the fabric in order to provide a more compact, more dimensionally stable roll product. The invention further provides a novel method of stabilizing the suspension fabric, using a novel temporary construct, for extending the fabric across the width of the bay, by extending a relatively small-diameter shaft through the core and temporarily mounting the shaft to the tops of two of the purlins which are part of the already-erected roof structure of the building, adjacent a first rafter on a first side of the bay over which the fabric is to be installed. The invention further provides for pulling the leading edge of the Z-folded fabric from the roll, and guiding that edge of the fabric across the width of the bay to the second rafter; and in the process drawing all, or substantially all, of the fabric from the roll core. The overall result is that the invention makes positive contributions to the safety and productivity of the fabric installation crew.

In a first family of embodiments, the invention comprehends, in a process of installing a fall protection system in a building roof structure, for protecting workers involved in installation of such roof structure, such building roof structure including structural roof elements which include at least first and second rafters, a space between the first and second rafters defining a first distance between the first and second rafters, each rafter having a length, a top, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge being disposed on, extending transverse to, and being connected to, the tops of the first and second rafters, and a plurality of intermediate purlins extending between the first and second rafters and spaced from each other between the eave and the ridge, the intermediate purlins being disposed on, and extending transverse to, the tops of the first and second rafters, a run extending from the first rafter to the second rafter between two adjacent ones of the purlins, the fall protection system comprising a grid-work of support bands, the grid-work of support bands comprising a first set of longitudinal support bands extending from the first rafter to the second rafter and being connected to the building structural roof elements, the first set of longitudinal support bands being spaced along the lengths of the first and second rafters, and a second set of lateral support bands extending from the eave toward the ridge and under the intermediate purlins, the bands of the second set of support bands having first and second end portions which are spaced along the lengths of the eave and the ridge, the fall protection system further comprising a suspension fabric overlying, and being supported by, the grid-work of support bands, and being attached to the building structural roof elements, a method of presenting the suspension fabric over the grid-work of support bands wherein the suspension fabric has been prepared as a rolled-up roll, the method comprising extending a shaft through the roll, lifting the roll, on the shaft, to an elevation of the purlins and placing the shaft on the next adjacent ones of the purlins, with the roll suspended on the shaft and over the run which is between the next adjacent ones of the purlins; and drawing the fabric from the roll and along the run toward the second rafter and onto the grid-work of bands, such that the fabric is unwound from the roll and supported by the grid-work of bands.

In some embodiments, the method further comprises temporarily mounting the shaft, against translational movement, to one or more of the purlins before drawing the suspension fabric from the roll.

In some embodiments, the method further comprises, after drawing the suspension fabric from the roll, releasing the shaft from the one or more purlins and setting the shaft aside.

In some embodiments, the method further comprises Z-folding the suspension fabric before preparing the suspension fabric rolled up as a roll.

In some embodiments, the method further comprises preparing the suspension fabric by winding the suspension fabric on a separate core, and the extending of the shaft through the roll comprising extending the shaft through the core.

In a second family of embodiments, the invention comprehends a method of preparing a suspension fabric for presentation over a grid-work of support bands in a roof structure in a building being constructed, wherein the suspension fabric is part of a fall protection system in a building roof structure, for protecting workers involved in installation of such roof structure, such building roof structure including structural roof elements which include at least first and second rafters, a space between the first and second rafters defining a first distance between the first and second rafters, each rafter having a length, a top, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge being disposed on, extending transverse to, and being connected to, the tops of the first and second rafters, and a plurality of intermediate purlins extending between the first and second rafters and spaced from each other between the eave and the ridge, the intermediate purlins being disposed on, and extending transverse to, the tops of the first and second rafters, a run extending from the first rafter to the second rafter between two adjacent ones of the purlins, the grid-work of support bands being part of the fall protection system, the grid-work of support bands comprising a first set of longitudinal support bands extending from the first rafter to the second rafter and being connected to the building structural roof elements, the first set of longitudinal support bands being spaced along the lengths of the first and second rafters, and a second set of lateral support bands extending from the eave toward the ridge and under the intermediate purlins, the bands of the second set of support bands having first and second end portions which are spaced along the lengths of the eave and the ridge, the fall protection system, when completed, further comprising the suspension fabric overlying, and being supported by, the grid-work of support bands, and being attached to the building structural roof elements, the suspension fabric having a specified length extending between the eave and the ridge, and a specified width extending between the first and second purlins, the method comprising Z-folding a such suspension fabric having the specified length and the specified width such that the fabric, as Z-folded, exhibits a length extending along the width of the suspension fabric; and rolling up the so Z-folded suspension fabric so as to present the Z-folded suspension fabric rolled up as a roll.

In some embodiments, the method further comprises passing the Z-folded fabric through a compression station and thereby applying compression across the Z-folded fabric as the Z-folded fabric passes through the compression station.

In some embodiments the compression station comprises first and second nip rolls, defining a compression nip which expels substantially all surface air out of the Z-folded fabric as the Z-folded fabric passes through the nip.

In some embodiments, the method further comprises maintaining tension on the Z-folded fabric between such compression nip and a winder, thereby to essentially prevent re-introduction of surface air into the compressed Z-folded web between the nip and the winder.

In some embodiments, the method further comprises, as a trailing edge of the Z-folded fabric approaches the winder, feeding a leading edge of a protective plastic film into a nip defined between the Z-folded fabric on the roll and the Z-folded fabric which is approaching the roll, and thereby introducing the protective plastic at a trailing edge portion of the Z-folded fabric, into the roll being wound.

In some embodiments, the method further comprises, after the trailing edge of the fabric has been wound onto the roll, temporarily continuing to wind the protective plastic film onto the roll until a suitably protective amount of the plastic film forms the outer layers of the roll, and then severing the plastic film which is being fed to the roll which is being wound.

In some embodiments, the method further comprises preparing the suspension fabric by winding the suspension fabric on a separate core, and extending a shaft through the core.

In some embodiments, the invention comprehends a method of presenting a suspension fabric over a grid-work of support bands in a roof under construction, comprising securing a roll of such rolled-up suspension fabric, extending a shaft through the roll, lifting the roll, on the shaft, to an elevation of the purlins and placing the shaft on the next adjacent ones of the purlins, with the roll suspended on the shaft in alignment with the run which is between the next adjacent ones of the purlins, and drawing the fabric from the roll and along the run toward the second rafter and onto the grid-work of bands, such that the fabric is unwound from the roll and supported by the grid-work of bands.

In some embodiments, the method further comprises temporarily mounting the shaft, against translational movement, to one or more of the purlins before drawing the suspension fabric from the roll.

In some embodiments, the method further comprises, after drawing the suspension fabric from the roll, releasing the shaft from the one or more purlins and setting the shaft aside.

In a third family of embodiments, the invention comprehends, in a process of installing a fall protection system in a building roof structure, for protecting workers involved in installation of such roof structure, such building roof structure including structural roof elements which include at least first and second rafters, a space between the first and second rafters defining a first distance between the first and second rafters, each rafter having a length, a top, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge being disposed on, extending transverse to, and being connected to, the tops of the first and second rafters, and a plurality of intermediate purlins extending between the first and second rafters and spaced from each other between the eave and the ridge, the intermediate purlins being disposed on, and extending transverse to, the tops of the first and second rafters, bays being defined along a length of the building between respective ones of the rafters, a run extending from the first rafter to the second rafter between first and second adjacent ones of the purlins, the fall protection system comprising a grid-work of support bands, the grid-work of support bands comprising a first set of longitudinal support bands extending from the first rafter to the second rafter and being connected to the building structural roof elements, the first set of longitudinal support bands being spaced along the lengths of the first and second rafters, and a second set of lateral support bands extending from the eave toward the ridge and under the intermediate purlins, the bands of the second set of support bands having first and second end portions which are spaced along the lengths of the eave and the ridge, the fall protection system further comprising a suspension fabric overlying, and being supported by, the grid-work of support bands, and being attached to the building structural roof elements, a temporary construct where the longitudinal and lateral support bands have been installed and the suspension fabric has not yet been installed, such construct comprising a roll of the suspension fabric; a shaft extending through the roll of suspension fabric such that the roll is suspended on the shaft; and the shaft overlying next adjacent ones of the purlins and being temporarily restrained against translational movement relative to the purlins, with the roll of suspension fabric over the run which is between the next adjacent ones of the purlins.

In some embodiments, the suspension fabric is Z-folded on the roll such that the fabric, as Z-folded, exhibits a length corresponding generally to the width of the respective bay and a width less than a width of the run adjacent which the roll is suspended.

In some embodiments, the invention further comprises first and second clamps clamped respectively to the next adjacent purlins, the shaft being restrained against translational movement relative to the purlins by, the clamps.

BRIEF DESCRIPTION OF THE DRAWINGS

Illustrative embodiments of the invention are described hereinafter, by way of example only, with reference to the accompanying drawings, wherein.

Figure 1:
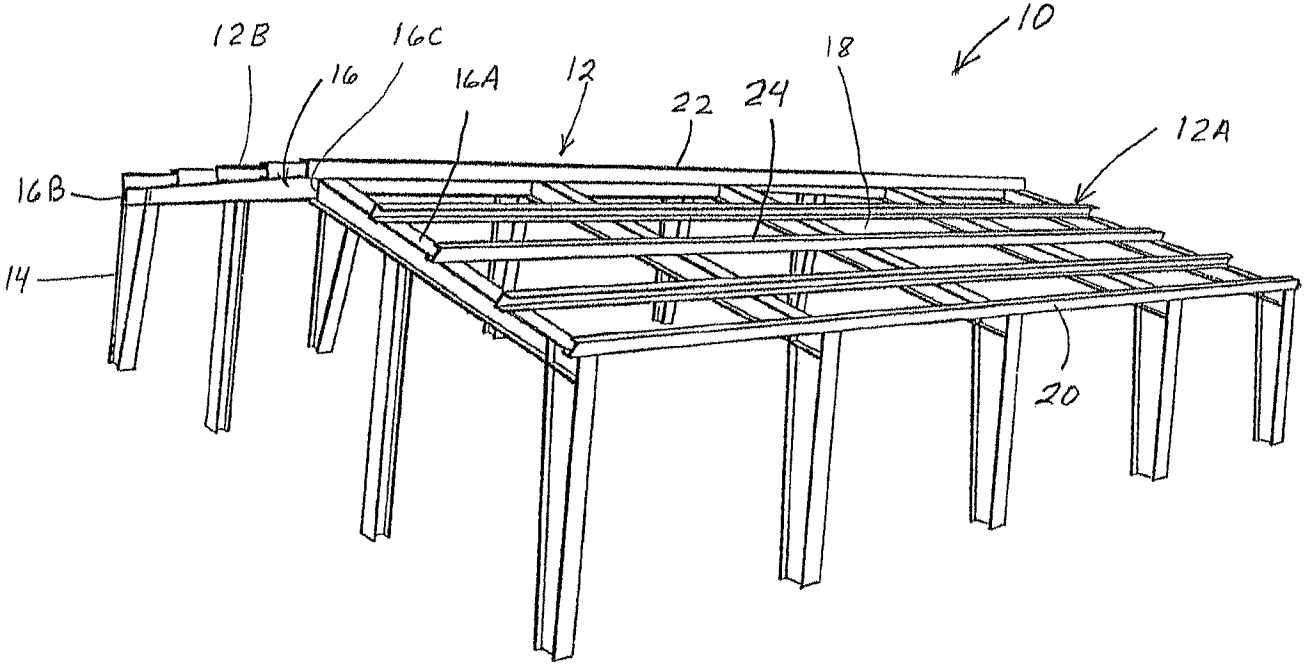
FIG. 1 is a perspective view, from above the eaves, of a typical metal building structure, including columns, rafters, eaves, ridges, and intermediate purlins.

The invention is not limited in its application to the details of construction, or to the arrangement of the components, or to the methods of construction, set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

FIG. 1 illustrates the primary structural members of a typical metal building 10 having first and second roof slopes 12A and 12B. Vertical support for the structural elements of the roof, designated generally as 12, is provided by upstanding columns 14 positioned along side walls and end walls of the building. Rafters 16 overlie the tops of the columns and are supported by the columns. Rafters 16 span the width of the building, creating a series of open spaces between rafters 16, the open spaces being commonly referred to as "bays" 18 in the construction arts. Bays 18 represent distances between respective ones of the rafters. Each rafter has an upper surface 16A, and opposing first 168 and second 16C ends.

Figure 2:
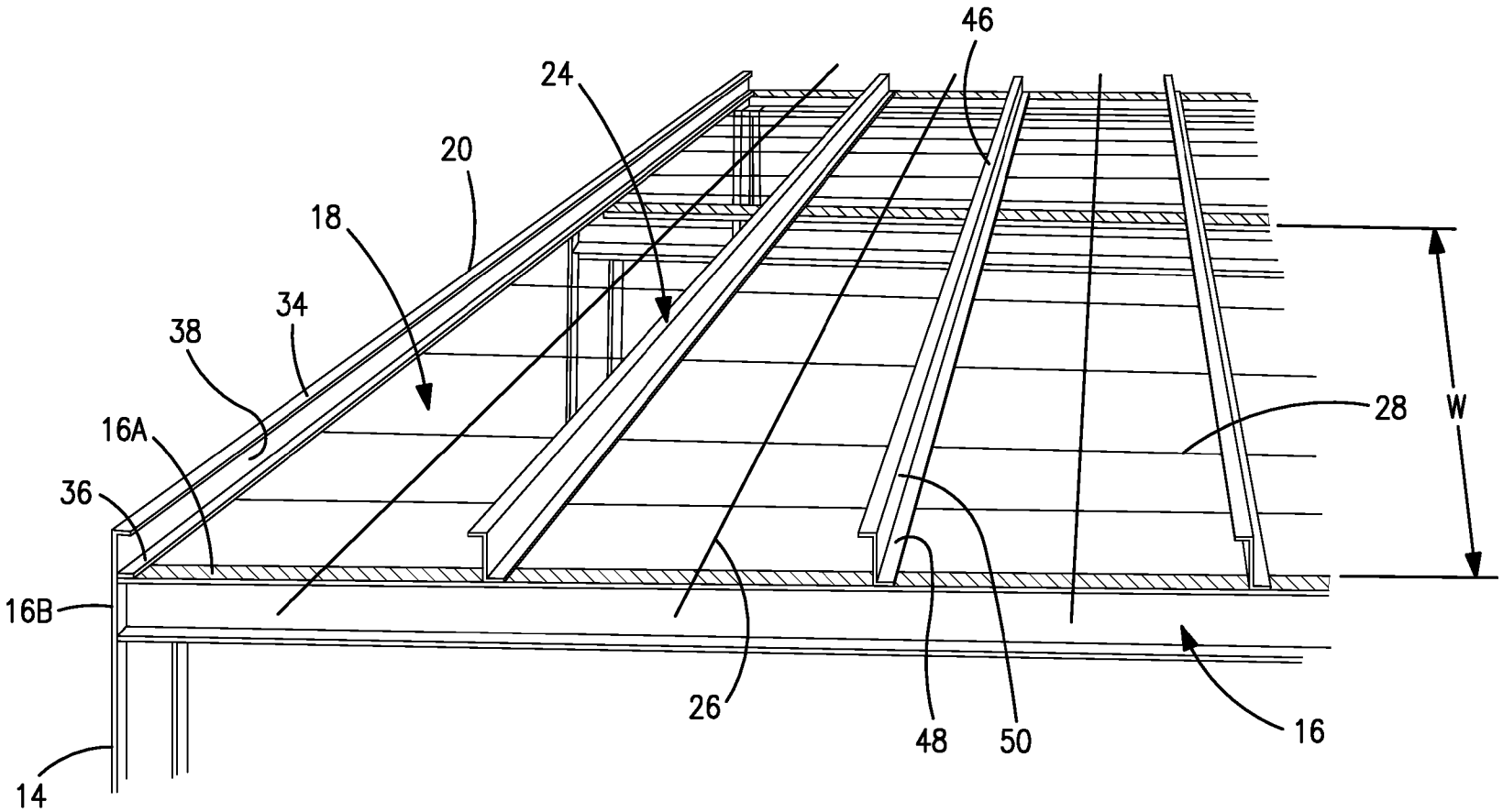
FIG. 2 is a perspective view, from above the roof, of part of a bay of a metal building, showing columns, rafters, purlins, an eave, and a grid-work of crossing bands.
Figure 4:
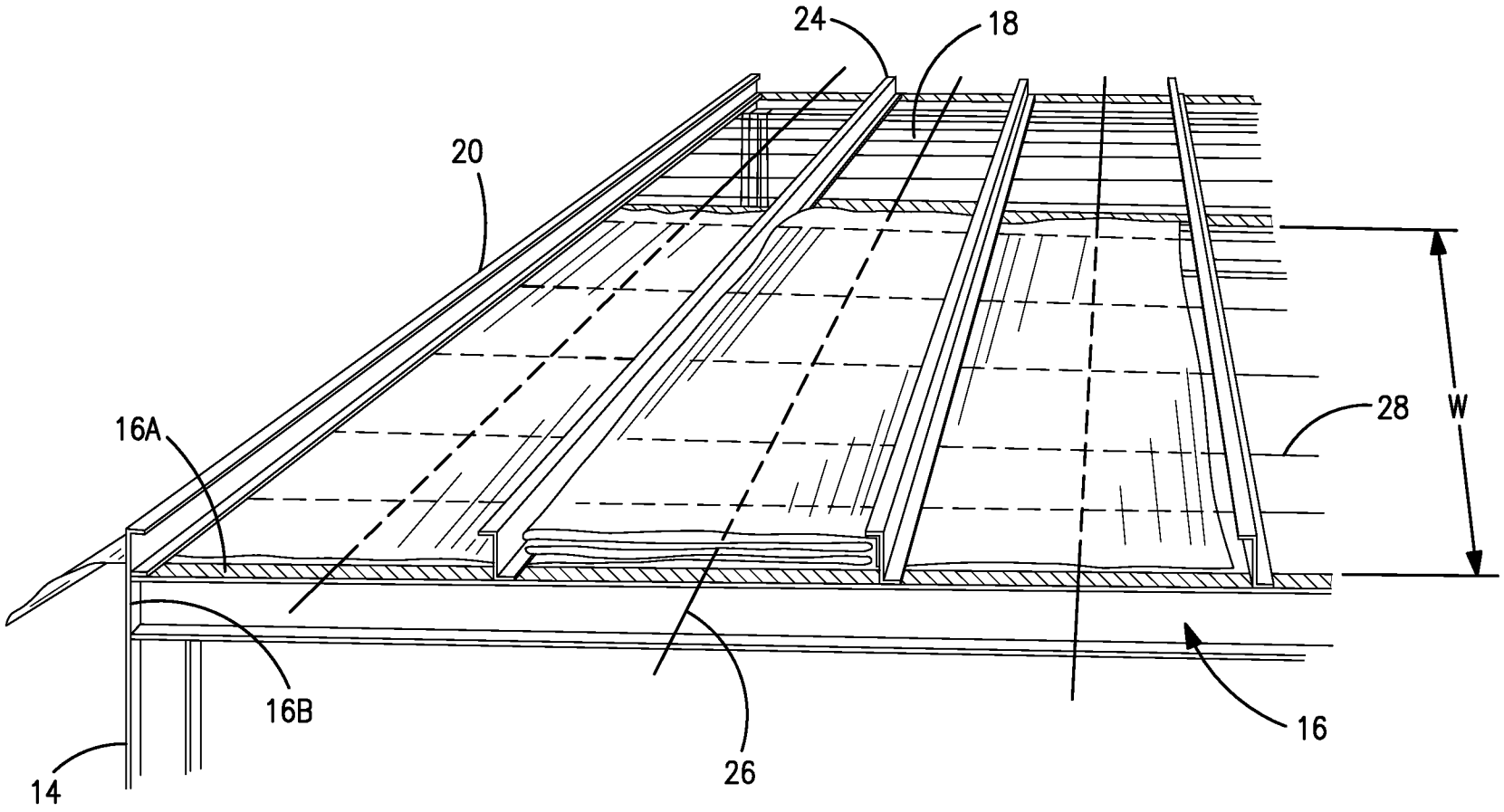
FIG. 4 is a perspective view as in FIG. 2 showing the suspension fabric of FIG. 3 having been extended fully across the width of the bay, and initial extensions of the fabric along the length of the bay over the band grid-work, under the eave, and under the purlins.

According to the embodiments illustrated in FIGS. 1, 2, and 4, eaves 20, expressing "C"-shaped cross-sections, are positioned at the down-slope ends of the rafters 16. Lengths of the eaves extend along the length of the building, above the outer wall of the building. The eaves provide lateral support to the skeletal structure of the building between respective ones of the columns 14, at the outer building wall. A given eave extends between the first ends 16B of respective ones of the rafters.

Figure 5:
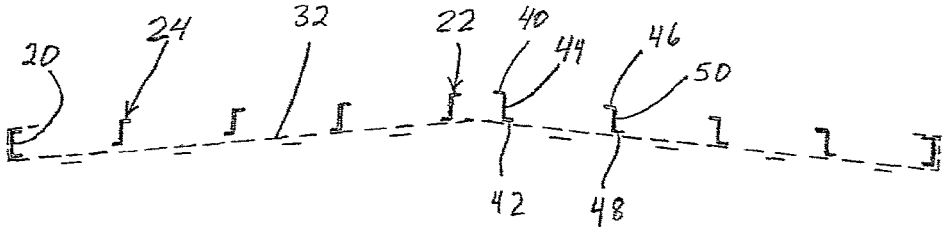
FIG. 5 is a diagrammatic end view of a roof structure of a metal building, showing longitudinal band spacing with respect to the eaves, the ridges, and the intermediate purlins.

Ridge members 22, expressing "Z"-shaped cross-sections as illustrated in FIG. 5, have lengths which overlie, and are attached to, the upper surfaces of rafters 16. The ridge members are positioned at the up-slope ends of the rafters, and run the length of the building parallel to the eaves, typically above the central portion of the building. The ridge members provide lateral support to the skeletal structure of the building between respective ones of rafters 16, typically at an internal portion of the building, and away from the building side walls in the illustrated embodiments. A given ridge member extends between the second ends 16C of the respective ones of the rafters. Where the roof has a single pitch direction, the ridge can be positioned proximate one of the outer walls of the building.

The ridge members and the eave members overlie, extend transverse to, and are attached to, the upper surfaces of the respective rafters 16, and are spaced from each other by distances which generally correspond to the lengths of the respective rafters between ends 16B and 16C.

Figure 7:
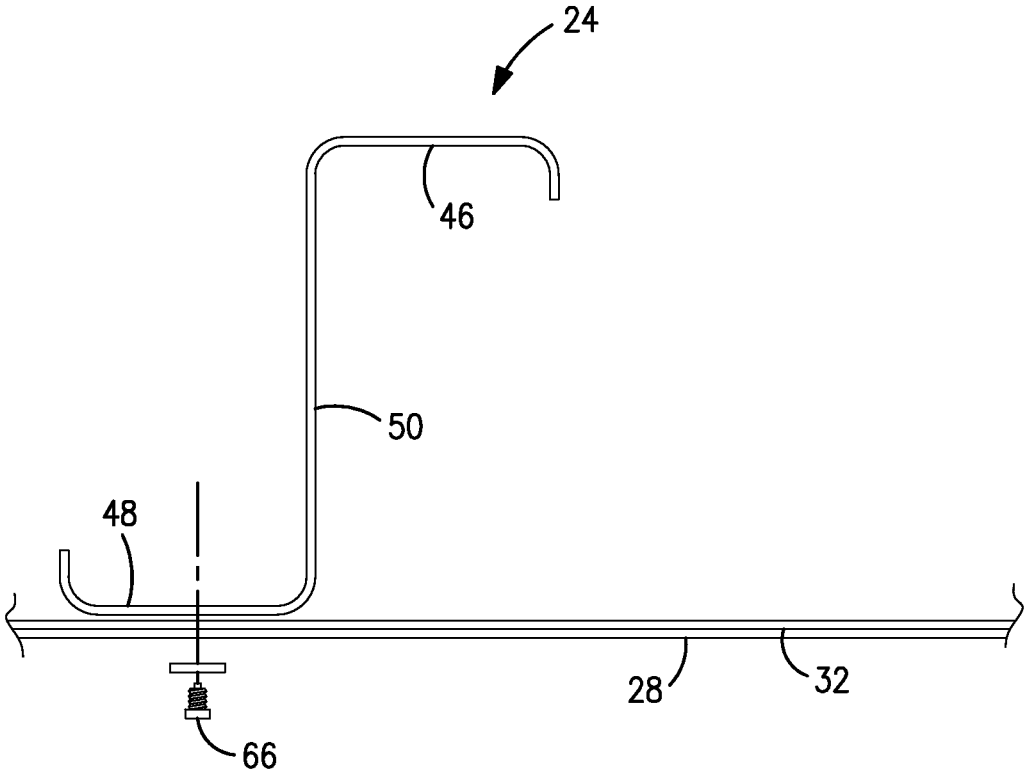
FIG. 7 is a cross-section of an intermediate purlin, and a Tek screw, with washer, positioned to extend the screw through the fabric and into the purlin bottom flange.

Intermediate purlins 24 express "Z"-shaped cross-sections, illustrated in FIG. 7. The intermediate purlins overlie, extend transverse to, and are attached to, upper surfaces 16A of the respective rafters. Purlins 24 are spaced from each other along the lengths of the rafters, the spaces between each pair of next adjacent ones of the purlins being referred to herein as "runs". The purlins extend parallel to each other and parallel to any ridges and eaves and, overall, span the length of the bay, whereby the purlins are displaced from each other and from any ridges and eaves along the spaces between the respective eave and the ridge.

As shown in FIG. 2, the fall protection support system, namely the suspension system, of interest to this invention includes a supporting grid-work formed by crossing elongate steel bands, including longitudinal support bands 26 and lateral support bands 28. Support bands 26, 28 of the grid-work are supported by various ones of the building structural members, as described herein, and the collective grid-work generally defines an imaginary plane, extending into the sheet of the drawing illustrated in FIG. 5. Such imaginary plane extends parallel to a set of imaginary straight lines, spaced from each other and extending between the lower surfaces of the eaves 20, the ridge 22, and intermediate purlins 24, and further extending parallel to imaginary straight lines which connect the upper surfaces of the rafters. Support bands 26, 28 support a high strength suspension fabric 32.

Figure 3:
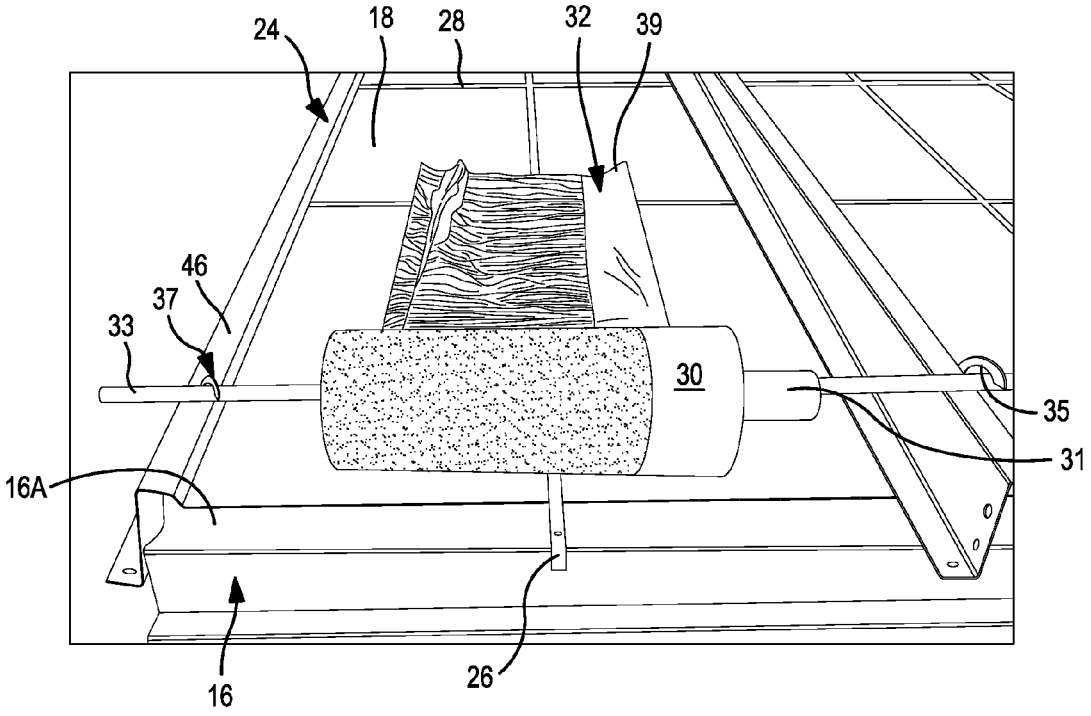
FIG. 3 is a perspective view from above the elevation of two purlins and a rafter, looking along a run of space from a first rafter toward a second rafter, showing a roll of suspension fabric mounted to the purlins, a leading edge of one side of the fabric having been drawn part-way across the width of the bay.

Fabric 32 is shown in FIG. 3 rolled up in a roll 30 on a fiberboard, e.g. cardboard core 31 which is e.g. 3-4 inches in diameter, ready to be unrolled across the width of the bay. A small diameter shaft 33, e.g. 1-2 inches diameter, extends through the core and extends out both ends of the core. Shaft 33 overlies, rests on, top flanges 46 of the respective next adjacent purlins shown in FIG. 3. The ends of shaft 33 extend through apertures 35 in hand clamps 37, such as vice-grip-type clamps, which are temporarily and tightly mounted to the top flanges 46 of the purlins. With the shaft so extending through apertures 35 in the tightened clamps 37, the position of the core, and thus the position of the roll of fabric, is stabilized as long as the clamps remain clamped to the purlins. Given that the bottom of the roll 30 of fabric is above the top surface 16A of the rafter, as shown, roll 30 turns freely on shaft 33 such that the fabric can be easily pulled from the roll and across the width of the bay 18. FIG. 3 shows a leading edge 39 of the rolled, Z-folded fabric being advanced across the width of the bay, with corresponding unwinding of the Z-folded fabric from roll 30.

Fabric 32 in the illustrated embodiments also serves as a vapor barrier for the insulation system which is ultimately installed at the roof of the building.

Starting with the structural skeleton of the building as illustrated in FIG. 1, a fall protection system of interest in the invention is installed generally as follows. Longitudinal metal bands 26 are extended from the upper surface of a first one of the rafters to the upper surface of a second one of the rafters at angles which are typically, but not necessarily, perpendicular to the respective rafters. The number of longitudinal bands 26 depends to some degree on the distance between the respective ones of the intermediate purlins 24. Typically, one or two longitudinal bands 26 are used in the run between each pair of next-adjacent purlins 24.

A length of a given longitudinal band 26 extends across a given bay and is extended across the upper surface of each rafter overlain by the respective band, and is attached to the upper surfaces, or other surfaces, of the respective rafters. Where the longitudinal band 26 extends across multiple bays, the longitudinal band is secured, for restrained longitudinal movement, to the upper surfaces of those rafters which are most remote from one another. Optionally, but not necessarily, the longitudinal band may be secured to one or more intermediate rafters.

Longitudinal bands 26 are fastened to the rafters or rake channels (not shown) which correspond with the end portions of the bands by conventional attachment means such as by self-drilling screws. Longitudinal bands 26 are pulled tight between the rafters so as to, in part, and at this stage of installation, begin to define the afore-mentioned band grid, and the imaginary plane of support provided by the band grid, immediately under the intermediate purlins. Band attachment tools, known in the art, may be used in attaching the bands, either temporarily or permanently, to the rafters or rake channels, thus to instill a suitable, conventionally known, level of tension in bands 26 as the bands are being installed.

Each eave has a top flange 34, a bottom flange 36, and an upstanding web 38 extending between the top and bottom flanges, and connecting the top flange to the bottom flange. The top and bottom flanges are arranged such that the profile of the eave defines a generally "C"-shaped structure, perhaps best seen in FIG. 6.

While the eave profiles shown define generally perpendicular turns between flanges 34 and 36, and upstanding web 38, actual eave profiles typically define a modest acute angle (not shown) between the bottom flange and the upstanding web and a corresponding modest obtuse angle (not shown) between the top flange and the upstanding web. Such acute and obtuse angles adapt the eave to the specific slope of the roof for which the eaves are designed, while providing that the upstanding web conform to the vertical orientation of the respective side wall of the building.

Correspondingly, each ridge has a top flange 40, a bottom flange 42, and an upstanding web 44 extending between the top and bottom flanges, and connecting the top flange to the bottom flange. The top and bottom flanges are arranged such that the profile of the ridge defines a "Z"-shaped structure, as illustrated in FIG. 5.

Similarly, each intermediate purlin 24 has a top flange 46, a bottom flange 48, and an upstanding web 50 extending between the top and bottom flanges, and connecting the top flange to the bottom flange. The top and bottom flanges are arranged such that the profile of the respective purlin defines a "Z"-shaped structure, illustrated in FIGS. 5 and 7.

Referring to FIGS. 2 and 4, lateral bands 28 are typically installed after the longitudinal bands 26 are in place. Lateral bands 28 extend transverse to, typically perpendicular to, the longitudinal bands. Lateral bands 28 generally underlie and support longitudinal bands 26. Lateral bands 28 may be first attached to the respective ridge 22. Bands 28 may be attached to any suitable surface of the ridge which enables the band to pass, from the location of attachment, under and in tensioned contact with, the bottom flange of the ridge. For example, a lateral band can be attached to the bottom surface of the bottom flange of the ridge, intervening fabric 32, and extend from there toward the eave.

The lateral bands are extended, from the bottom surface of the bottom flange of the ridge toward the respective eave, passing under some or all of the longitudinal bands, and pulled tight to minimize sag in both the lateral bands and the respective overlying longitudinal bands. A given lateral band may optionally pass over one or more of the longitudinal bands. The so-tightened lateral bands are in general contact, again with intervening fabric, with the bottom surface of the bottom flange of the respective eave. With the so-tightened lateral bands in contact with the bottom surface of the bottom flange of the respective eave, the lateral bands are fastened to the eave so as to maintain the tension in the lateral bands, thus to lift the lateral bands toward the bottom flanges of the overlying intermediate purlins.

The number of lateral bands 28 to be used between a respective pair of next-adjacent rafters, and the spacing between the lateral bands, varies with the distance between the rafters. Typically, the lateral bands are nominally 36 inches to 40 inches apart, optionally 48 inches apart in some instances, and up to 60 inches apart in other instances. Those skilled in the art can determine suitable spacing for the lateral bands for a given building construction project.

A variety of banding stock can be used for bands 26 and 28. A typical banding stock is a hot-dip zinc/aluminum alloy-coated Grade 80 structural steel, 0.023 inch thick. Such Grade 80 banding is sometimes referred to in the industry as "full hard". Such steel banding, as used, is typically about 1 inch wide and continuous length. Such traditional "full hard" steel banding is available from Steelscape, A BlueScope Steel Company, Kalama, Wash. as ZINCALUME® Steel Grade 80 (Class 1).

Representative properties of such Grade 80 (Class 1) banding, 0.023 inch thick, from Steelscape are as follows:

Yield strength—100.1 ksi average, 93.9-104.1 ksi range

Tensile strength—102.2 ksi average, 95.4-105.3 ksi range

Elongation in 2 inch sample—10% average, 9.6-10.3% range

Hardness, Rockwell B Scale—93.4 average, 92-95 range

"Ksi" means "thousands of pounds per square inch".

Each lateral band may be attached by a Tek screw to the bottom flange of each intermediate purlin, whereby a substantial fraction of the force of a worker falling, or the force of a drop test bag, is transferred through the respective lateral bands to the next adjacent purlins and to any adjacent rafter.

Another banding stock suitable for use for at least some of the lateral bands 28 is relatively softer and more yielding than the Grade 80 banding. The physical dimensions of such bands are the same, at 1 inch width, and 0.023 inch thickness, whether the Grade 80 banding stock, or the softer, Grade 50, banding stock, is used. Representative properties of such Grade 50 (Class 1) banding, 0.023 inch thick, from Steelscape, are as follows:

Yield strength, average—58.1 ksi, 51.3~64.0 ksi range

Tensile strength, average—72.0 ksi, 65.5-78.7 ksi range

Elongation in 2 inch sample—30.8% average, 22.5-36.6% range

Hardness, Rockwell B Scale—72.3 average, 64-79 range

An overall acceptable range of properties for the 0.023 inch thick banding, 1 inch wide, is as follows:

Yield strength—50 ksi~105 ksi,

Tensile strength—50 ksi~105 ksi,

Elongation in 2 inch sample—10%~40%, and

Hardness, Rockwell B Scale—64-95.

Where the force of a drop/impact/fall is applied at the lateral band which is next-adjacent a rafter, that force may be transferred by a single one of such lateral bands, in addition to the affected longitudinal band, to the building structural roof members.

Figure 6:
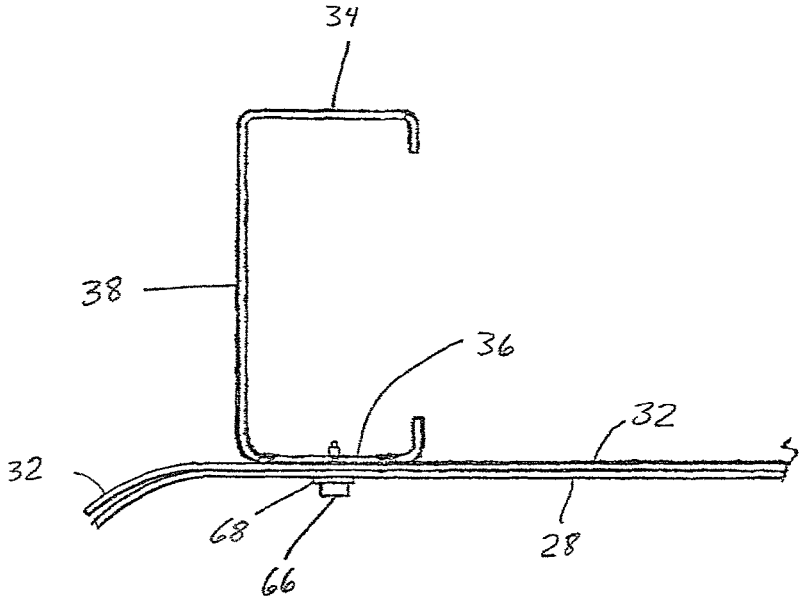
FIG. 6 is an edge view showing a lateral band fastened, attached, to the bottom flange of the eave.

FIG. 6 shows the attachment of a lateral band to an eave 20 using a standard Tek screw. FIG. 7 shows the impending attachment of the lateral band to an intermediate purlin using a standard Tek screw.

Figure 8:
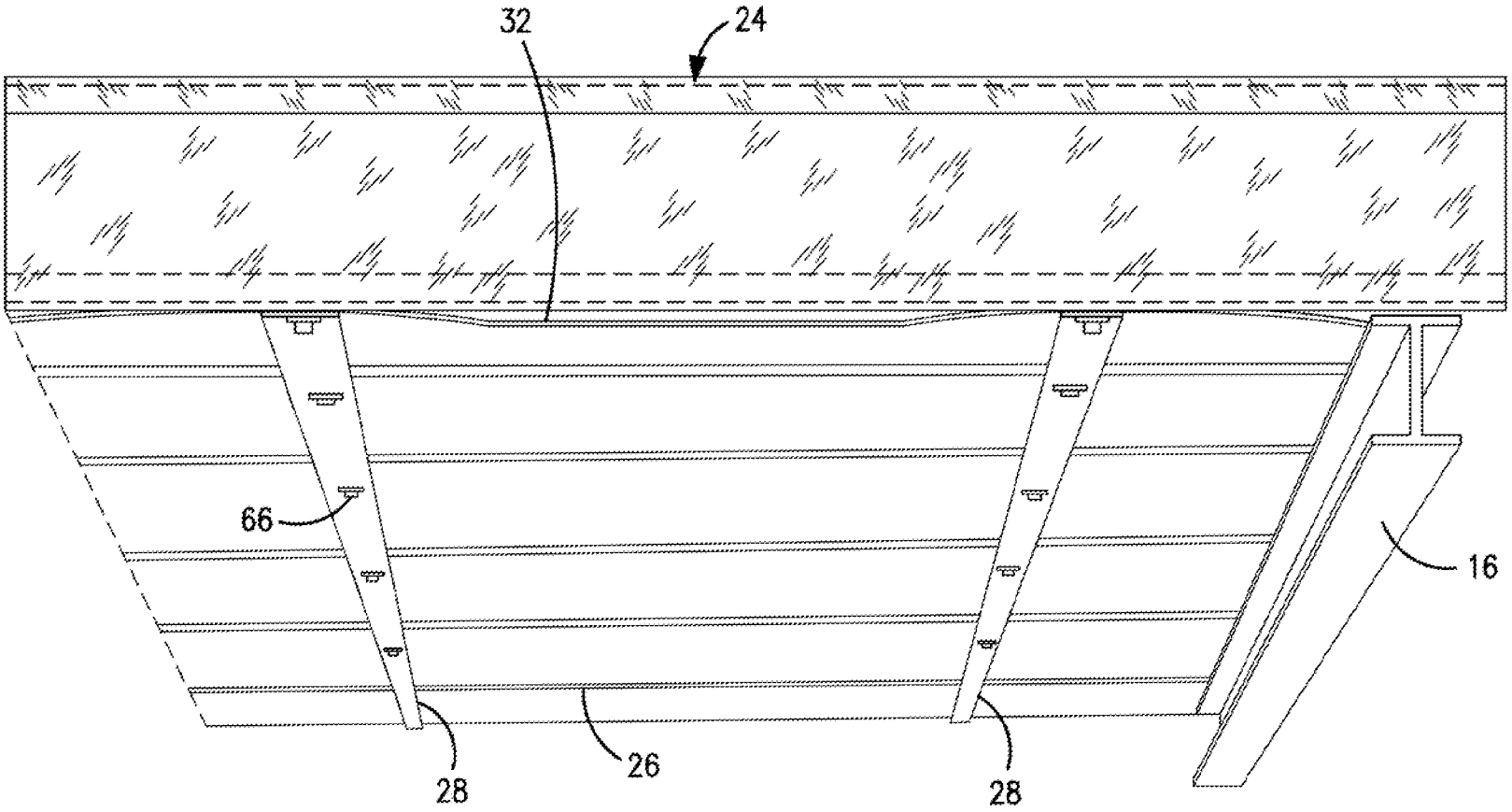
FIG. 8 is a perspective view from below the installed suspension fabric, showing a purlin mounted on one of the rafters, also showing the lateral bands and the longitudinal bands collectively supporting the suspension fabric across a bay.

FIG. 8 illustrates that longitudinal bands 26 are supported by lateral bands 28, in that each longitudinal band is underlain by at least one of the tightened lateral bands. Referring again to FIGS. 2 and 4, it is seen again that the longitudinal bands are secured against longitudinal movement only at rafters 16.

Yield, tensile and elongation properties of the banding are determined using an Instron Tensile Tester according to ASTM A370-12a. Briefly, a two-inches-long section of a dog-bone shaped sample is placed in the jaws of the test machine, and stretched by the machine until the sample breaks. Yield and ultimate tensile are recorded by the testing machine. Elongation is measured manually according to the test procedure after the sample breaks.

Banding used in the invention is distinguished from steel bar stock in that steel bar stock is stiff and rigid. By contrast, the banding used in the invention is thin and flexible such that the banding is typically shipped to the user in rolls. When the banding stock is cut to the e.g. specified 1-inch width, and the resulting bands are loosely draped over rafters spaced e.g. 25 feet apart, mid-sections of the bands readily drape downwardly by multiple feet from the elevations of the rafters. Further, such banding is completely incapable of supporting itself or the overlying suspension fabric, across the length and width of a typical bay, until substantial ensile force, which can be manually applied using hand tools, is applied to the banding.

Certain fabrics are known in the art for use as suspension fabrics in roof insulation systems, and such fabrics may be acceptable in the fall protection systems of the invention, provided that the bands used in the band grid-work of the invention are sufficiently close together. An exemplary fabric, which the inventors have tested and found satisfactory for use with the band grid-work discussed herein, is an HDPE scrim having the following characteristics as specified by the fabric supplier:

Nominal thickness—9 mils (0.23 mm)

Nominal weight—4.3 oz/yd$^2$ (149 g/m$^2$)

Grab Tensile—Warp 136 lb (605 N)/Weft 126 lb (559 N)

Strip Tensile—Warp 100 lb/in (877)/Weft 90 lb/in (799)

Tongue Tear—Warp 50 lb (222 N)/Weft 45 lb (200 N)

Mullen Burst—245 psi (1690 kPa)

Moisture vapor transmission—0.02 perms.

A typical bay 18 is about 25 feet wide, between pairs of next-adjacent rafters. Within a given bay, lateral bands 28 extend parallel to each other, parallel to the respective rafters which define the bay, and are generally spaced apart by about 36 inches to 40 inches. Thus, a desired spacing between lateral bands 28 is 36-40 inches; and up to 48 inches, and optionally up to 60 inches is accepted where the increase can reduce the number of bands without compromising installation of the suspension fabric, or the ability of the fall protection system to successfully catch and hold either a falling worker or a falling test bag.

FIG. 8 shows, in its typical configuration of the fall protection system of interest in the invention, that lateral bands 28 can be attached to each purlin in a conventional manner, namely by screwing a Tek screw 66, with accompanying washer, through a hole in the lateral band, thence through the suspension fabric, and thence through the lower flange of the respective purlin. The suspension fabric is thus trapped between the lower flange of the purlin and the respective washer/screw combination, which tightly clamps the suspension fabric to the lower surface of the lower flange of the purlin.

Method of Installing Fall Protection Systems

Installation of a fall protection system of interest in the invention begins after the columns, rafters, ridges, eaves, and intermediate purlins are in place about at least a given bay. Typically, installation of the fall protection system begins after erection/emplacement of all of the columns, rafters, ridges, eaves, and purlins.

Installation of the fall protection system typically begins by installing longitudinal bands 26. A given longitudinal band is installed by unwinding band material from a roll and extending the band material over the tops of the respective rafters and across a given bay or bays. At least one longitudinal band is extended in the run between each next-adjacent pair of purlins to at least the next rafter, and is cut to length. The longitudinal bands are manually stretched tight with hand tools, and the so-tightened bands are fastened to the respective rafters and/or rake channels with Tek screws. As illustrated in the drawings, the longitudinal bands typically extend perpendicular to the rafters. The so-partially-installed, tightened, longitudinal bands extend from rafter to rafter at generally the height of the tops of the rafters, but some nominal amount of sag of the longitudinal bands exists between the rafters at this stage of installation.

Typically, the purlins are spaced no more than 5 feet apart. In this invention, typically a single band is installed in each run, namely between each pair of next-adjacent purlins so long as the purlin spacing is no more than the typical maximum of 5 feet. In some instances, an additional longitudinal band 26 may be used in one or more of the runs.

Once the longitudinal bands 26 have been emplaced and tightened, banding for lateral bands 28 is unrolled under the longitudinal bands, and one end of the banding is secured to the respective ridge or purlin, or to an opposing eave. The lateral banding material is extended to the eave of the respective bay, optionally threaded above one or more of the longitudinal bands along the way, and then tightened sufficiently to raise both the lateral band and the overlying longitudinal bands into close proximity with the intermediate purlins. This process is repeated along the width of the bay, e.g. between the rafters, until the desired number of lateral bands has been emplaced across the width of the bay.

As an alternative, lateral bands 28 may be installed first, followed by installation of the longitudinal bands. In such case, the longitudinal bands are threaded above enough of the lateral bands that the lateral bands support the longitudinal bands.

With the band grid system thus temporarily in place, a zigzag-folded roll 30 of suspension fabric 32 mounted on a roll core 31, is ready to be elevated to the height of the rafters, by inserting a shaft 33 through the core. Shaft 33 is long enough to extend, from both ends of the roll, across two purlins. The roll is then lifted to the work elevation. Conveniently, two workers, one holding on each end of the shaft, are thus raised in a scissor lift or the like to the work elevation. At the work elevation, the workers transfer the shaft onto the two purlins on opposing sides of the respective run where the fabric is to be used. As illustrated in FIG. 3, vice grip-type clamps 37, having holding apertures 35 in the clamp jaws, are placed over the shaft on respective ends of the roll, and are clamped to the respective purlins. The clamps can be secured the top flanges 46 of the respective purlins. The shaft and clamps are selected such that the shaft easily fits through apertures 35 in the clamps when the clamp jaws are firmly secured/clamped to the purlins.

With the clamps securely mounted to the purlins, the core, and thus the roll of fabric, is translationally stabilized relative to the end of the space over which the fabric is to be unrolled, while being free to rotate about shaft 33.

Roll 30 is relatively compact, with air between layers of the fabric having been substantially all removed, such that a roll which is intended to extend across a 25 foot width of a bay, and along up to a 100 foot length of the bay, is no more than about 14 inches gross diameter, and no more than 5 feet, typically no more than 4 feet, optionally no more than 3 feet, in length.

With the roll translationally stabilized, and with the roll/core able to freely rotate about shaft 33, a worker can then begin to draw the end of the fabric from the roll and over bands 26 and 28. As the fabric is drawn from the roll, the roll rotates, and the fabric being drawn from the roll sags downwardly under its own weight, onto bands 26 and 28. Bands 26 and 28 thus function as primary support for the Z-folded fabric as the fabric is being drawn from the roll, as indicated in FIG. 3.

Another way of extending the fabric across the bay is to affix the terminal end of the fabric to the structure at the near side of the bay and then move the roll, unrolling the fabric as the roll is moved across the bay. For example, with shaft 33 omitted, the loose end of the fabric is clamped to the first rafter or the respective rake channel, with the fabric feeding from the bottom of the roll. The roll, supported by the longitudinal band is then simply rolled across the bay. The weight of the moving roll is supported by the respective longitudinal band, as well as any lateral bands as those bands are crossed. While the bands support the weight of the roll, a worker may need to stabilize the roll in order that the roll not fall through an opening between the bands, for example to the left or right of the longitudinal band if a single band is used.

For example, the shaft may be extended through the core as earlier described. The shaft is placed on the purlins as shown in FIG. 3 with the fabric feeding from the bottom of the roll toward the near/first rafter. The loose end of the fabric is clamped to the first rafter or the respective rake channel. A worker then pushes or pulls the roll and/or the shaft, with the shaft still riding on the top flanges of the respective purlins, toward the second/remote rafter. As the shaft and roll move, the core freely rotates on the shaft such that the core/roll rotates, unwinding the fabric from the roll/core. By the time the roll reaches the second rafter, all of the fabric has been unwound from the core, and only the empty core and the shaft are left being supported by the top flanges of the purlins.

The fabric on the roll has been sized, in length and width of a single layer of such fabric, such that the length of the Z-folded fabric, as wound on the roll, is equal to the width of a single layer of the fabric needed in the bay, and such that the length of fabric, as Z-folded on the roll, is equal to the length of a single layer of the fabric needed in the bay. Accordingly, when the entirety of the length of the fabric, as wound on the roll, has been unwound and extended across the run, from rafter to rafter, between the two purlins, the fabric, in its Z-folded condition extends the full width of the bay, and the Z-folded fabric is fully supported by bands 26 and 28. FIG. 4 illustrates that, with a first end of the now-unrolled Z-folded fabric at the first/distal rafter, the second end of the Z-folded fabric extends to, and ends at, the second/remote rafter. The length and width of a single layer of the Z-folded fabric both allow for overlap onto and beyond the rafters, eave, and ridge, sufficient for any attachment to desired elements of the roof structure.

Once the fabric has been removed from the core, clamps 37 can be released at any convenient time whereupon the clamps 37, shaft 33, and core 31 are removed and set aside.

With the Z-folded fabric thus extended across the width "W" of the bay, the ends of the fabric are then pulled, individually, toward the eave and the ridge, working the leading ends of the fabric under the intervening intermediate purlins and above the band grid, as is known in the art. The initial phase of the process of so-extending the fabric into a single layer along the length and width of the bay is illustrated in FIG. 4.

With the fabric having been generally extended the full length and width of the bay over which the fabric is to be suspended, namely over the band grid and under the intermediate purlins, the lateral bands are then attached to the intermediate purlins, one self-drilling Tek screw attaching each lateral band and the fabric, to each purlin, typically beginning at the ridge and working toward the eave. As a such Tek screw/washer is driven tight into the purlin, the fabric is correspondingly driven tight against the bottom surface of the lower flange of the purlin. Screws 66 are driven into each purlin, whereby each lateral band is supported by each purlin as illustrated in FIG. 8.

Once the attachments to the intermediate purlins have been completed, the temporary attachments of the lateral bands to the eave are released, and the lateral bands are permanently attached to the eave, e.g. using screws 66 driven through the lateral bands, e.g. as illustrated in FIG. 6.

Sides of the fabric are then cut around the purlins at each rafter, as known in the art, and the sides of the fabric are secured to the top surfaces of the rafters such as by adhesive, also as known in the art.

With both the longitudinal and lateral bands so secured to the roof structure; with the fabric so secured to the ridge and eave by the lateral bands and secured to the rafters or rake channels by e.g. adhesive or other attachment, installation of the fall protection system is complete and ready to protect workers who subsequently install other elements of the building while working at the roof elevation; such elements as the roof insulation and the roof panels.

Suspension fabric 32, which in the preferred embodiment consists of a vapor barrier material, is trimmed to size before installation. The suspension fabric is installed one bay 18 at a time and, in the case of large buildings or buildings with high gables, fabric 32 for each half of the bay may be divided at ridge 22 and may be installed separately. Of course, multiple work crews can be working on different bays, or different slopes of a given bay, at the same time.

Method of Converting the Suspension Fabric

Figure 9:
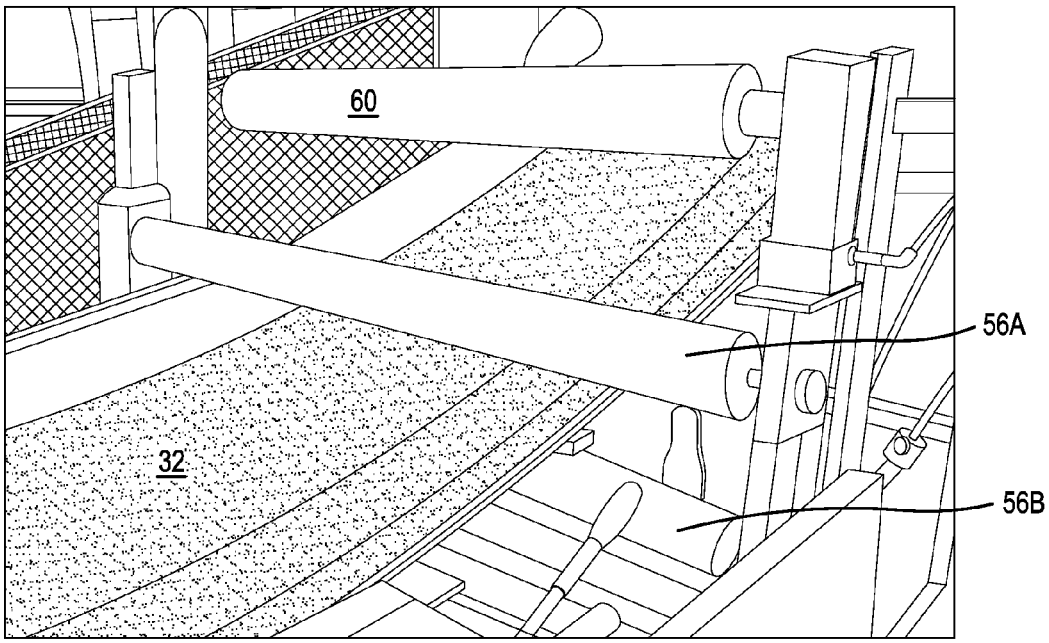
FIG. 9 is a photograph, showing a perspective view of a pair of separated nip rolls at a fabrication work station where substantially all the air can be expelled from a Z-folded suspension fabric prior to the fabric being rolled up as a roll onto a core.
Figure 10:
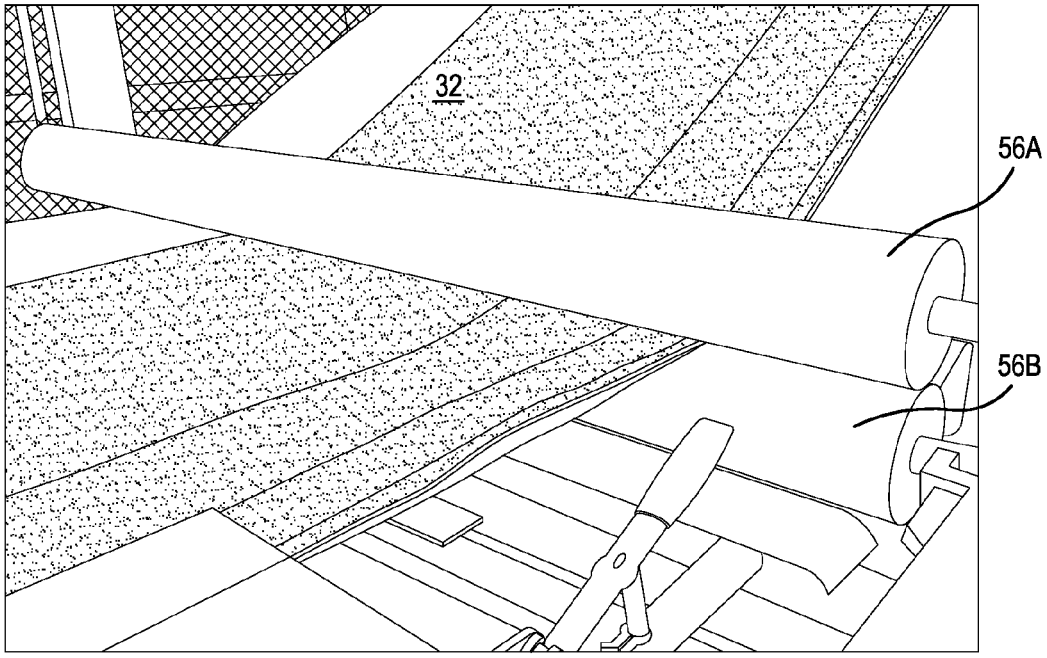
FIG. 10 is a photograph showing the work station of FIG. 9 after the nip rolls have been brought together on a length of the fabric which is being processed.

FIGS. 9-14 show a Z-folded fabric 32 laid out along a production line 52, with the fabric being supported by a work table 54, as the fabric is being fabricated into a roll product. FIG. 9 shows how the fabric 32 passes between first and second nip rolls 56A and 56B. FIG. 10 shows the nip rolls closed on the fabric. As the fabric advances through the nip rolls, the pressure between the nip rolls expels substantially all of the air from between the layers of the Z-folded fabric.

Figure 11:
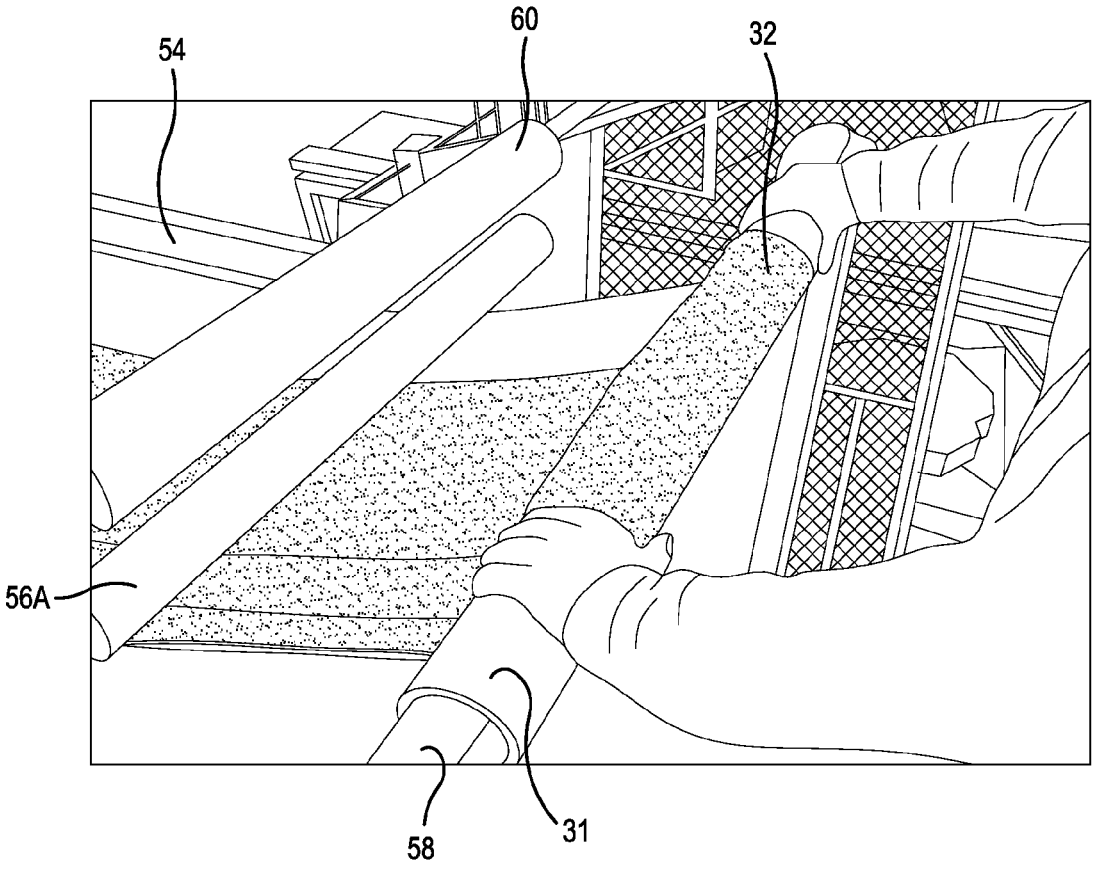
FIG. 11 is a photograph showing a winder, downstream of the nip rolls, where a leading edge of the Z-folded fabric has been wound about the core.

FIG. 11 shows the same work area as FIGS. 9 and 10, from a downstream direction relative to FIGS. 9 and 10, looking back upstream along the processing line. FIG. 11 shows a worker initiating winding of the Z-folded fabric 32 on a 3-inch cardboard core 31 mounted on a winder 58. With substantially all the air expelled from the Z-folded fabric at nip rolls 56A, 565, the fabric can be tightly wound on core 31 by winder 58.

FIG. 11 further shows a roll of protective plastic 60 mounted essentially above nip rolls 56A, 565 and upstream of winder 58, but within reach of a worker standing behind the winder.

Figure 12:
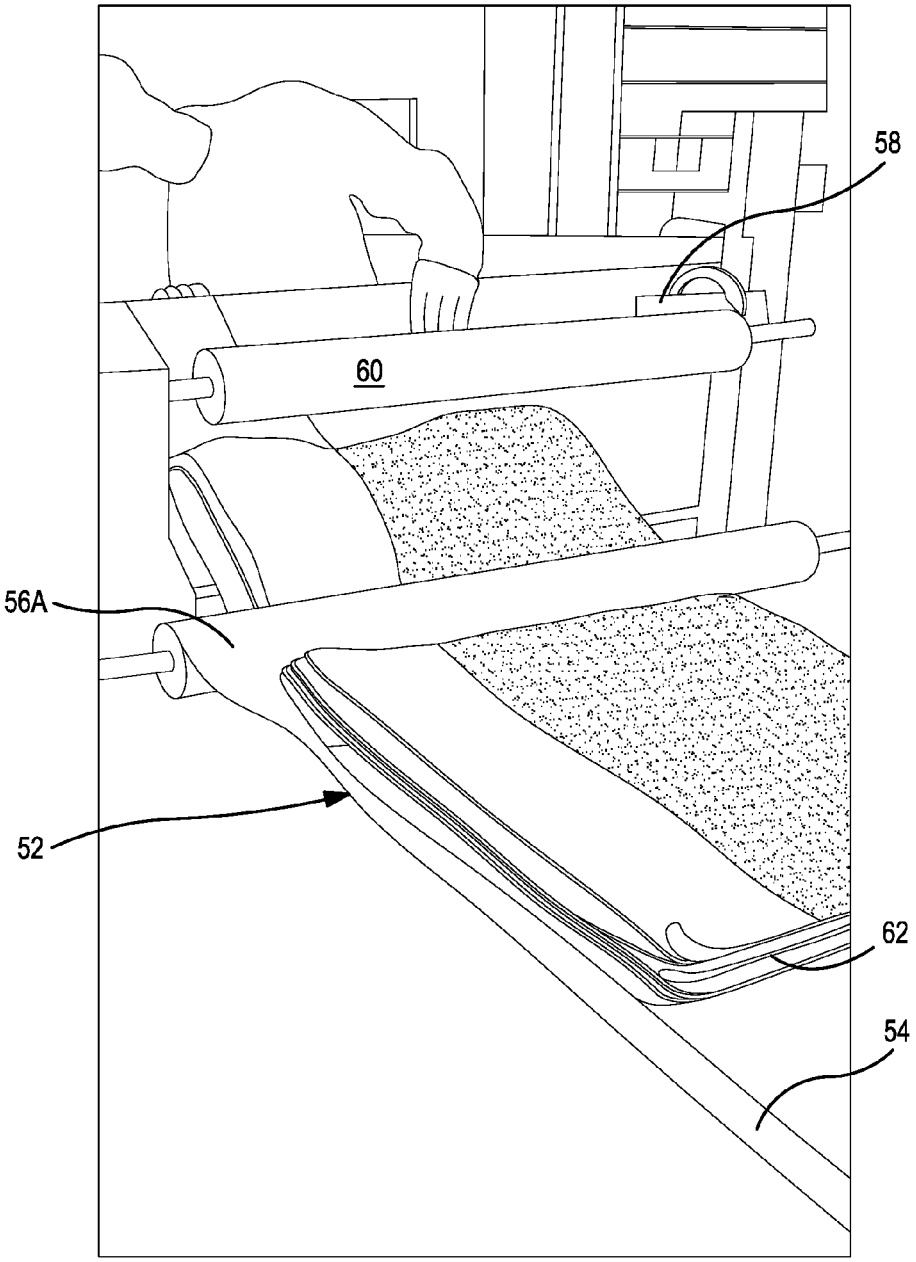
FIG. 12 is a photograph showing both the nip rolls and the winder, and a roll of protective plastic mounted essentially over the nip rolls and upstream of the winder, as the trailing edge of the Z-folded fabric approaches the nip rolls.
Figure 13:
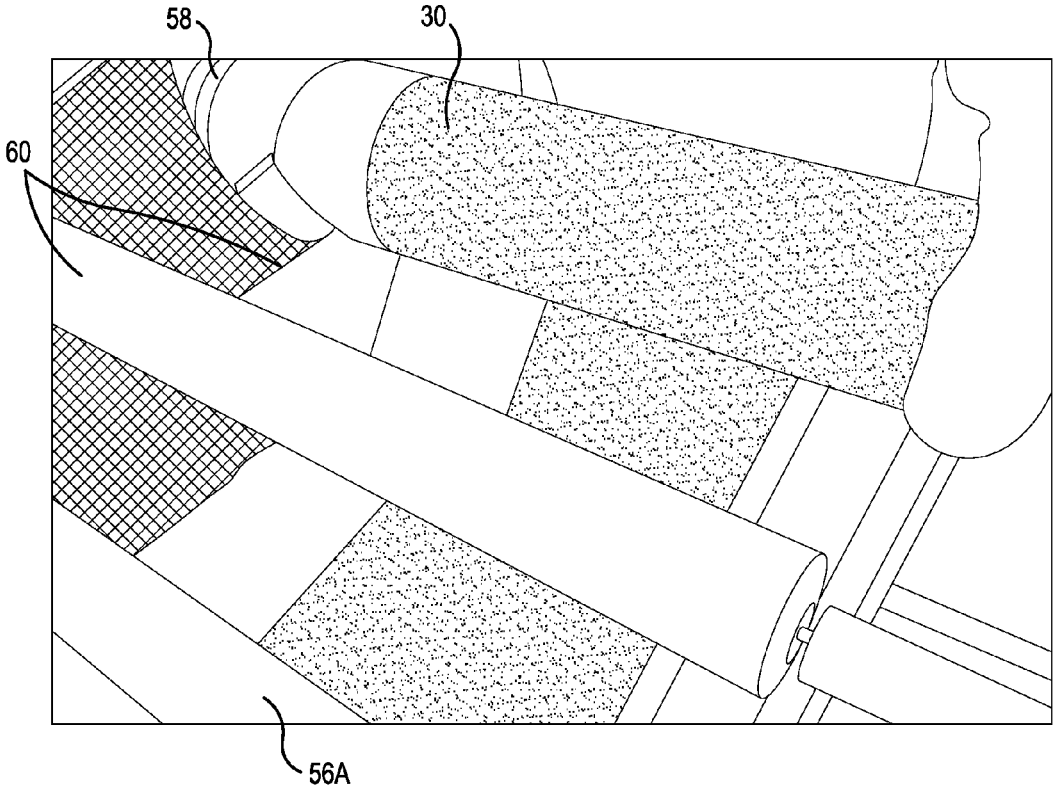
FIG. 13 is a photograph showing the nip rolls closed on the Z-folded fabric to create a nip squeezing the fabric, the winder receiving the nip, and a roll of protective plastic mounted essentially over the nip and upstream of the winder, and a worker feeding a leading edge of the protective plastic into the nip formed between the fabric on the roll and the fabric being fed onto the roll.
Figure 14:
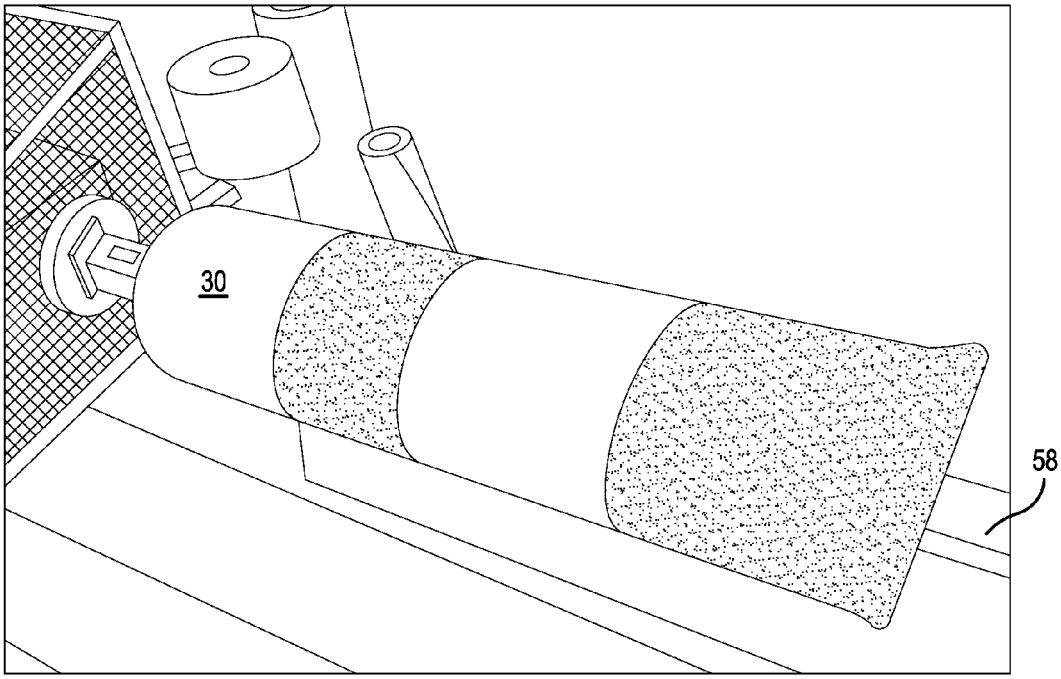
FIG. 14 is a photograph showing the finished roll product, wrapped in the protective plastic, still on the winder.
Figure 15:
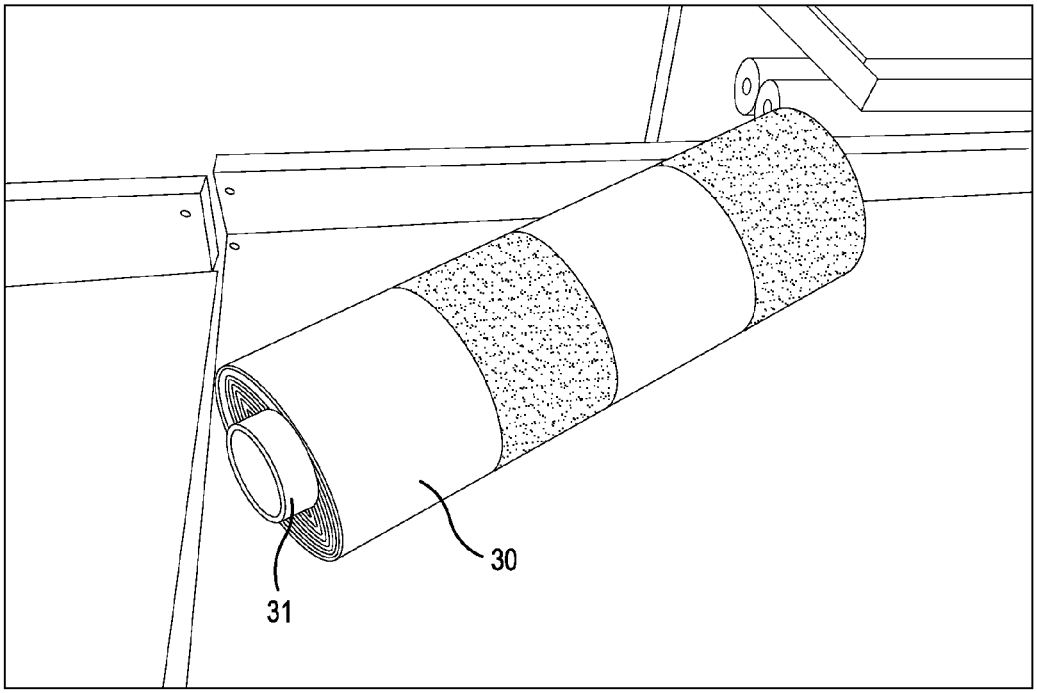
FIG. 15 is a photograph showing the finished roll product, removed from the winder.

FIG. 12 shows the winding operation temporarily stopped as the trailing edge 62 of the Z-folded fabric approaches the closed nip rolls. FIG. 13 shows the worker feeding a leading edge of protective plastic 60 into the nip formed between the fabric which is on the roll and the fabric which is approaching the roll. FIG. 14 shows the finished roll, still on the winder, where the trailing edge of the Z-folded fabric has been wound up on the roll, with a layer of the protective plastic wrapped about the outer surface of the fabric on the roll with the protective plastic film still connected to both the plastic feed roll and the roll of fabric. FIG. 15 shows the roll after the protective plastic has been cut, separating the plastic feed roll from the plastic-protected roll of fabric.

The process of producing the rolled suspension fabric product is generally as follows.

Multiple lengths of the fabric are cut from a roll of fabric having an indefinite length. The lengths of such multiple lengths of fabric correspond to the specified length of fabric needed for the length of a particular bay of a building which is to be constructed. The multiple lengths of fabric are then seamed together longitudinally to the specified width, and any excess width is trimmed from the resultant seamed fabric. The so-seamed and so-trimmed fabric is then Z-folded in known manner such that the folds in the fabric extend in the direction of the width of the bay of the building, for which bay the fabric has been fabricated whereby the turns/folds in the so-folded fabric extend in the direction of the length of the bay of the building, for which the fabric has been fabricated.

The Z-folded fabric is then transferred to elongate work table 54 with the length of the Z-folded fabric extending along the length of the work table. At the work table, nip rolls 56A, 56B are checked to be sure the nip rolls are separated. If the nip rolls are not separated, the rolls are separated from each other before proceeding further. With the nip rolls separated, the leading edge of the fabric on the work table is fed through the nip between the nip rolls as illustrated in FIG. 9 and is drawn up to, and secured to winder 58 with e.g. a piece of tape or other releasable securement.

With the Z-folded fabric thus threaded between the nip rolls and onto the winder, the nip rolls are brought together as illustrated in FIG. 10 such that, as the Z-folded fabric passes through the nip, essentially all air is expressed, squeezed, from between the layers of the fabric. Winder 58 is then powered, driving the winder and correspondingly drawing the Z-folded fabric through the nip at nip rolls 56A, 56B. The nip rolls squeeze the air out of the Z-folded fabric thereby flattening any spaces between the layers of fabric. FIG. 12 illustrates the Z-folded fabric upstream of the nip rolls, where it is seen that, at the trailing edge of the fabric, the layers are spaced from each other at the 180 degree turns of the fabric. The nip rolls squeeze out the air at those turns, thus flattening the Z-folded fabric. The winder maintains a draw tension on the fabric between the nip rolls and the winder whereby the winder winds up the so-flattened fabric while the fabric is still flattened such that the layers of fabric, as wound, are tightly against each other on the roll. The result is a compact, dense roll substantially devoid of surface air between the layers of fabric.

As the trailing end of the fabric approaches the nip between rolls 56A and 56B, the operator stops the winding process.

With the winding stopped, the operator feeds a leading edge of the protective plastic 56, from the roll of protective plastic, into the nip between the fabric on the wound roll and the fabric which is approaching the roll. With that protective plastic in place in the nip, the winding is resumed. When the winding is resumed, the winder draws the remaining portion of the Z-folded plastic onto the roll while also drawing the protective plastic onto the roll, with the result that, when the trailing edge of the Z-folded fabric has been wound up on the roll, the protective plastic continues to wind onto the roll of fabric, fed from the roll of protective plastic. The purpose of the protective plastic is to protect the fabric which has been wound onto the roll. Once the trailing edge of the fabric has been wound up on the roll, a shipping label can, if desired, be fed into the roll and further covered with one or more layers of the protective plastic which is subsequently wound onto the roll. When a suitable quantity of protective plastic has been wound onto the roll, optionally over the shipping label, the winding operation is stopped and the protective plastic is severed. The loose end of the protective plastic on the roll is secured, such as by friction, or by mutual attraction of layers of the plastic for each other, or by tape.

The so-wound roll is then removed from the winder. The so-removed roll is illustrated in FIG. 15, ready for shipment to the construction site. At the construction site, a shaft 33 is inserted through core 31, and the fabric roll is lifted to the installation elevation, and temporarily mounted to respective ones of the purlins for dispensing of the fabric across a building bay as discussed herein above and as illustrated in FIG. 3.

As alluded to earlier, the suspension fabric has been cut, prior to being wound into roll 30, to a size having a dimension a few inches longer, at each side and each end, than the dimensions of the bay to be overlaid.

The fall protection systems of interest in the invention are designed to be of sufficient strength to catch and support a worker's weight, generally between 250 and 400 pounds. The system is tested by dropping a 400 lb. weight with the center of gravity of the weight, before the weight is dropped, being 42 inches above a worker's walking height, thus 42 inches plus the height of the purlins, namely about 50.5 inches above the fabric. To pass the test, the system must stop the falling weight at any point in the bay which is so protected. In one test specified by OSHA, 400 lb. of washed gravel or sand is placed into a reinforced bag that can tolerate being dropped repeatedly. The test bag is 30 inches in diameter. The 400 pound bag is hoisted above the fall protection system to a height of 42 inches above the plane of the intermediate purlins, measuring from the center of the so-filled bag. A cord supporting the weight of the bag is then released, allowing the weight to free fall in one concentrated load. The weight can be dropped onto any part of the fall protection system to test different areas.

Although the invention has been described with respect to various embodiments, it should be realized this invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. In a process of installing a fall protection system at in a building roof structure, such building roof structure including at least first and second rafters, a space between the first and second rafters defining a first distance between the first and second rafters, each rafter having a length, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge extending transverse to the first and second rafters, and a plurality of intermediate purlins, having lengths, and extending between the first and second rafters and spaced from each other between the eave and the ridge, a run extending from the first rafter to the second rafter between adjacent ones of the purlins, the fall protection system comprising a grid-work of support bands, and a suspension fabric overlying, and being supported by, the grid-work of support bands, a method of presenting the suspension fabric over the grid-work of support bands wherein the suspension fabric has been prepared as a rolled-up roll, the method comprising:

(a) extending a shaft through the roll;

(b) lifting the roll to an elevation of the purlins and placing the shaft in direct contact with next adjacent ones of the purlins, with the roll suspended on the shaft and over the run which is between the next adjacent ones of the purlins; and (c) drawing the fabric from the roll and along the run toward the second rafter and onto the grid-work of bands, such that the fabric is unwound from the roll and supported by the grid-work of bands.

2. A method as in claim 1, further comprising temporarily fixedly immovably mounting the shaft, against translational movement, to one or more of the purlins before drawing the suspension fabric from the roll.

3. A method as in claim 2, further comprising, after drawing the suspension fabric from the roll, releasing the shaft from the fixed immovable mounting to the one or more purlins.

4. A method as in claim 1, further comprising Z-folding the suspension fabric before preparing the suspension fabric rolled up as a roll.

5. A method as in claim 1, further comprising preparing the suspension fabric by winding the suspension fabric on a core, and the extending of the shaft through the roll comprising extending the shaft through the core before lifting the roll above the purlins.

6. A method of preparing a suspension fabric for presentation over a grid-work of support bands in a roof structure in a building being constructed, wherein the suspension fabric is a first part of a fall protection system in a building roof structure, such building roof structure including at least first and second rafters, a space between the first and second rafters defining a first distance between the first and second rafters, each rafter having a length, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge extending transverse to the first and second rafters, and a plurality of intermediate purlins, having lengths, and extending between the first and second rafters and spaced from each other between the eave and the ridge, the grid-work of support bands being a second part of the fall protection system, the suspension fabric, as prepared for presentation over the grid-work of support bands, having a specified length for extending between the eave and the ridge, and a specified width for extending between the first and second rafters, the method comprising:

(a) Z-folding a suspension fabric having the specified length and the specified width such that the fabric, as Z-folded, exhibits a length extending along the width of the suspension fabric; and (b) rolling up the so Z-folded suspension fabric so as to present the Z-folded suspension fabric rolled up as a roll, whereby the suspension fabric can be installed by extending a shaft through the roll, lifting the roll, on the shaft, to an elevation of the purlins and placing the shaft at an elevation above next adjacent ones of the purlins, with the roll suspended on the shaft, and (e) drawing the fabric from the roll and along a run between next adjacent ones of the purlins and toward the second rafter, such that the fabric is unwound from the roll.

7. In a process of installing a fall protection system at a building roof structure, such building roof structure including at least first and second rafters, a space between the first and second rafters defining a first distance between the first and second rafters, each rafter having a length, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge extending transverse to the first and second rafters, and a plurality of intermediate purlins, having lengths, and extending between the first and second rafters and spaced from each other between the eave and the ridge, bays being defined along a length of the building between respective ones of the rafters, a run extending from the first rafter to the second rafter between adjacent ones of the purlins, the fall protection system comprising a grid-work of support bands, and a suspension fabric overlying, and being supported by, the grid-work of support bands, a temporary construct where the grid-work of support bands has been installed and the suspension fabric has not yet been installed, said construct comprising:

(a) a roll of the suspension fabric;

(b) a shaft extending through said roll of suspension fabric such that said roll is suspended on said shaft; and (c) said shaft overlying next adjacent ones of the purlins, with said roll of suspension fabric adjacent a such run which is between the next adjacent ones of the purlins, said shaft being restrained, fixedly immovable against translational movement relative to the purlins whereby at least portions of the suspension fabric can be unrolled from the roll and drawn along the lengths of the next adjacent purlins without movement of the roll.

8. A temporary construct as in claim 7, the suspension fabric being Z-folded on the roll such that the fabric, as Z-folded, exhibits a length corresponding generally to the width of the respective bay and a width less than a width of the run adjacent which the roll is suspended.

9. A temporary construct as in claim 7, the restraining of the shaft comprising first and second clamps clamped respectively to the next adjacent purlins, the shaft being restrained against translational movement relative to the purlins.

10. A method as in claim 6, further comprising temporarily mounting the shaft, fixedly immovable against translational movement, to one or more of the purlins before unrolling the suspension fabric from the roll.

11. A method as in claim 6, further comprising passing the Z-folded fabric through a compression station and thereby applying compression across the Z-folded fabric as the Z-folded fabric passes through the compression station.

12. A method as in claim 11 wherein the compression station comprises first and second nip rolls, defining a compression nip which expels substantially all surface air out of the Z-folded fabric as the Z-folded fabric passes through the nip.

13. A method as in claim 12, further comprising maintaining tension on the Z-folded fabric between such compression nip and a winder, thereby to essentially prevent re-introduction of surface air into the compressed Z-folded web between the nip and the winder.

14. A method as in claim 6, further comprising, as a trailing edge of the Z-folded fabric approaches the winder, feeding a leading edge of a plastic film into a nip defined between the Z-folded fabric on the roll and the Z-folded fabric which is approaching the roll, and thereby introducing the plastic at a trailing edge portion of the Z-folded fabric, into the roll being wound.

15. A method as in claim 14, further comprising, after the trailing edge of the fabric has been wound onto the roll, temporarily continuing to wind the plastic film onto the roll until a suitably protective amount of the plastic film forms the outer layers of the roll.

16. A method as in claim 6, further comprising temporarily mounting the shaft, against translational movement, in direct contact with one or more of the purlins before drawing the suspension fabric from the roll and, after drawing the suspension fabric from the roll, releasing the shaft from the one or more purlins.

17. A method as in claim 6, a run extending from the first rafter to the second rafter between adjacent ones of the purlins, and wherein the roll of suspension fabric is in alignment with the run between the next adjacent ones of the purlins, and wherein the width of the fabric, as Z-folded on the roll, is less than a shortest distance across the space between the next adjacent ones of the purlins adjacent which the roll is mounted.

18. A method as in claim 6, further comprising proceeding with installation of the fabric by placing the shaft in direct contact with the next adjacent ones of the purlins.

19. A method as in claim 6, further comprising proceeding with installation of the fabric by drawing the fabric onto the grid-work of bands while the roll of suspension fabric is fixedly immovable.

20. A method as in claim 6, further comprising proceeding with installation of the fabric by drawing the fabric from the roll, and as the fabric is drawn from the roll, advancing the so-drawn fabric along the lengths of the respective purlins.

21. In a process of installing a fall protection system in a building roof structure, such building roof structure including at least first and second rafters, a space between the first and second rafters defining a first distance between the first and second rafters, each rafter having a length, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge extending transverse to the first and second rafters, and a plurality of intermediate purlins, having lengths, and extending between the first and second rafters and spaced from each other between the eave and the ridge, a run extending from the first rafter to the second rafter between adjacent ones of the purlins, the fall protection system comprising a grid-work of support bands, and a suspension fabric overlying, and being supported by, the grid-work of support bands, and being attached to the building structural roof elements, a method of presenting the suspension fabric over the grid-work of support bands wherein the suspension fabric has been prepared as a rolled-up roll, the method comprising:

(a) extending a shaft through the roll to make a roll-shaft combination;

(b) lifting the roll-shaft combination to an elevation of the purlins and placing the shaft on the next adjacent ones of the purlins, with the roll suspended on the shaft and over the run which is between the next adjacent ones of the purlins; and (c) drawing the fabric from the roll and along the run toward the second rafter and onto the grid-work of bands, such that the fabric is unwound from the roll and supported by the grid-work of bands.

22. A method as in claim 21, further comprising temporarily fixedly immovably mounting the shaft, against translational movement, to one or more of the purlins before drawing the suspension fabric from the roll.

23. A method as in claim 22, further comprising, after drawing the suspension fabric from the roll, releasing the shaft from the fixed immovable mounting to the one or more purlins.

24. A method as in claim 21, further comprising Z-folding the suspension fabric before preparing the suspension fabric rolled up as a roll.

25. In a process of installing a fall protection system in a building roof structure, such building roof structure including at least first and second rafters, a space between the first and second rafters defining a first distance between the first and second rafters, each rafter having a length, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge extending transverse to the first and second rafters, and a plurality of intermediate purlins, having lengths, and extending between the first and second rafters and spaced from each other between the eave and the ridge, a run extending from the first rafter to the second rafter between adjacent ones of the purlins, the fall protection system comprising a grid-work of support bands, and a suspension fabric overlying, and being supported by, the grid-work of support bands, and being attached to the building structural roof elements, a method of presenting the suspension fabric over the grid-work of support bands wherein the suspension fabric has been prepared as a rolled-up roll, the method comprising:

(a) extending a shaft through the roll to make a roll-shaft combination;

(b) positioning the roll-shaft combination at an elevation such that a bottom of the roll is above the grid-work of support bands and disposed adjacent a such run; and (c) drawing the fabric from the roll and moving the so-drawn fabric along the lengths of the respective next adjacent purlins.

26. A method as in claim 25, further comprising temporarily fixedly immovably mounting the shaft, against translational movement, to one or more of the purlins before drawing the suspension fabric from the roll.

27. A method as in claim 25, further comprising, after drawing the suspension fabric from the roll, releasing the shaft from the fixed, immovable mounting to the one or more purlins.

28. A method as in claim 25, further comprising Z-folding the suspension fabric before preparing the suspension fabric rolled up as a roll.

29. A method as in claim 25, further comprising temporarily mounting the shaft, against translational movement, in direct contact with one or more of the purlins before drawing the suspension fabric from the roll.

30. In a process of installing a fall protection system in a building roof structure, such building roof structure including at least first and second rafters, a space between the first and second rafters defining a first distance between the first and second rafters, each rafter having a length, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge extending transverse to the first and second rafters, and a plurality of intermediate purlins, having lengths, and tops, and extending between the first and second rafters and spaced from each other between the eave and the ridge, a run extending from the first rafter to the second rafter between adjacent ones of the purlins, the fall protection system comprising a grid-work of support bands, and a suspension fabric overlying, and being supported by, the grid-work of support bands, and being attached to the building structural roof elements, a method of presenting the suspension fabric over the grid-work of support bands wherein the suspension fabric has been prepared as a rolled-up roll, the method comprising:

(a) positioning a roll of the suspension fabric at an elevation such that a bottom of the roll is above the grid-work of support bands and disposed adjacent a such run;

(b) fixedly immovably mounting the roll against translational movement; and (c) while the roll is so fixedly immovably mounted, drawing the suspension fabric from the roll and moving the so-drawn fabric along the lengths of the respective next adjacent purlins.

31. A method as in claim 30, further comprising Z-folding the suspension fabric before preparing the suspension fabric as a roll.

32. A method as in claim 30, further comprising preparing the suspension fabric by winding the suspension fabric on a core, and extending a shaft through the core comprising extending the shaft through the core before positioning the roll at the elevation where the bottom of the roll is above the grid-work of support bands.

33. A method as in claim 31 wherein positioning the roll of suspension comprises fixedly immovably mounting the roll of suspension fabric in alignment with a such run between next adjacent ones of the purlins, and wherein the width of the fabric, as Z-folded on the roll, is less than a shortest distance between the next adjacent ones of the purlins adjacent which the roll is mounted.

34. In a process of installing a fall protection system in a building roof structure, such building roof structure including at least first and second rafters, a space between the first and second rafters defining a first distance between the first and second rafters, each rafter having a length, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge extending transverse to the first and second rafters, and a plurality of intermediate purlins, having lengths, and tops, and extending between the first and second rafters and spaced from each other between the eave and the ridge, a run extending from the first rafter to the second rafter between adjacent ones of the purlins, the fall protection system comprising a grid-work of support bands, and a suspension fabric overlying, and being supported by, the grid-work of support bands, and being attached to the building structural roof elements, a method of presenting the suspension fabric over the grid-work of support bands wherein the suspension fabric has been prepared as a rolled-up roll, the method comprising:

(a) positioning a roll of the suspension fabric at an elevation such that a bottom of the roll is above the grid-work of support bands and disposed adjacent a such run;

(b) drawing the suspension fabric from the roll; and (c) with the bottom of the roll above the grid-work, moving the so-drawn fabric relative to the lengths of the respective next adjacent purlins.

35. A method as in claim 34, further comprising Z-folding the suspension fabric before preparing the suspension fabric as a roll.

36. A method as in claim 34, further comprising preparing the suspension fabric by winding the suspension fabric on a core.

37. A method as in claim 35 wherein positioning the roll of suspension fabric comprises temporarily fixedly immovably mounting the roll of suspension fabric in alignment with a such run between next adjacent ones of the purlins, and wherein the width of the fabric, as Z-folded on the roll, is less than a shortest distance between the next adjacent ones of the purlins adjacent which the roll is mounted.

38. In a process of installing a fall protection system in a building roof structure, such building roof structure including at least first and second rafters, a space between the first and second rafters defining a first distance between the first and second rafters, each rafter having a length, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge extending transverse to the first and second rafters, and a plurality of intermediate purlins, having lengths, and tops, and extending between the first and second rafters and spaced from each other between the eave and the ridge, a run extending from the first rafter to the second rafter between adjacent ones of the purlins, the fall protection system comprising a grid-work of support bands, and a suspension fabric overlying, and being supported by, the grid-work of support bands, and being attached to the building structural roof elements, a method of presenting the suspension fabric over the grid-work of support bands wherein the suspension fabric has been prepared as a rolled-up roll, the method comprising:

(a) positioning a such roll of the suspension fabric adjacent a such run, at an elevation such that a bottom of the roll is below the tops of the respective next adjacent ones of the intermediate purlins; and (c) drawing the fabric from the roll and into the respective run.

39. A method as in claim 38, further comprising temporarily fixedly immovably mounting the roll, against translational movement while the fabric is being drawn from the roll.

40. A method as in claim 39, further comprising, after drawing the suspension fabric from the roll, releasing the roll from the fixed immovable mounting to the one or more purlins.

41. A method as in claim 38, further comprising Z-folding the suspension fabric before preparing the suspension fabric rolled up as a roll.

42. A method as in claim 38, further comprising extending a shaft through the roll and temporarily mounting the shaft, against translational movement, in direct contact with one or more of the purlins before drawing the suspension fabric from the roll.

* * * * *